US006062054A

United States Patent [19]

Abiru et al.

[11] Patent Number: 6,062,054

[45] Date of Patent: May 16, 2000

[54] SPRING FORMING APPARATUS

[75] Inventors: Norifumi Abiru; Eiji Obayashi, both of Owariasahi, Japan

[73] Assignee: Asahi-Seiki Manufacturing Co., Ltd., Owariasahi, Japan

[21] Appl. No.: 09/030,318

[22] Filed: Feb. 25, 1998

[30] Foreign Application Priority Data

May 23, 1997 [JP] Japan ..... 9-133758

[51] Int. Cl.[7] ..... B21F 11/00; B21F 3/00

[52] U.S. Cl. ..... 72/132; 72/138; 72/140

[58] Field of Search ..... 72/137, 138, 135, 72/140, 145, 130, 131, 132

[56] References Cited

U.S. PATENT DOCUMENTS

| | | | |
|---|---|---|---|
| 4,669,289 | 6/1987 | Itaya . | |
| 4,893,491 | 1/1990 | Ohdai et al. . | |
| 4,947,670 | 8/1990 | Wu | 72/140 |
| 5,105,641 | 4/1992 | Veit . | |

FOREIGN PATENT DOCUMENTS

| | | |
|---|---|---|
| Y2-3-57312 | 12/1991 | Japan . |
| B2-4-734 | 1/1992 | Japan . |
| B2-4-74101 | 11/1992 | Japan . |
| B2-6-2296 | 1/1994 | Japan . |
| B2-6-7970 | 2/1994 | Japan . |
| B2-6-85952 | 11/1994 | Japan . |
| B2-7-61518 | 7/1995 | Japan . |
| 8-174120 | 7/1996 | Japan . |
| 9-85377 | 3/1997 | Japan . |

*Primary Examiner*—Rodney Butler
*Attorney, Agent, or Firm*—Oliff & Berridge, PLC

[57] ABSTRACT

A first large drive gear for slider driving mechanisms and a second large drive gear for a tool rotating driving mechanism are disposed coaxially with an axis of a wire feeding quill and in parallel with a rear surface of a front base frame panel, and a single small drive gear and a plurality of small driven gears corresponding to a plurality of wire working units are disposed around each of these large drive gears. A plurality of slider driving mechanisms and at least one tool rotating driving mechanism are operated with a single common servomotor respectively.

17 Claims, 16 Drawing Sheets

SPRING FORMING APPARATUS

BACKGROUND OF THE INVENTION

1. Field of the Invention

The present invention relates to a spring forming apparatus, and more specifically the spring forming apparatus comprising a wire feeding unit by which a wire as a spring material is forcibly fed with utilization of at least a pair of wire feeding rollers and fed into a wire working region through a quill, and a plurality of separate wire working units by which the wire fed from the wire feeder unit is bent, coiled and cut to obtain a spring.

2. Description of Related Art

There have been proposed various types of spring forming apparatuses. Some of them will be described below:

(1) JP-B2-4-734 discloses a spring forming apparatus in which a plurality of tools which movable between an advanced position of wire working and a retreated position, the tools being arranged so as to surround a quill through which a wire to be worked is fed out to the wire working position. The spring forming apparatus includes two large gears which drive a forming tool and a cutting tool and which are arranged in parallel to each other so as to be rotatable around the axis of the quill. The two large gears are driven independently by corresponding driving motors, respectively, under control of an NC device. Each of the large gears engages with several small gears to rotate a driving cam for causing the tools to move between the advanced position and the retreated position so that the two tools can be operated simultaneously.

(2) JP-B2-4-74101 discloses a torsion spring manufacturing apparatus by which a torsion spring is formed by introducing a wire into a gap between a winding tool and a claw provided on the outer circumference of the winding tool by a predetermined length and axially moving the winding tool while rotating around the axis. The apparatus has feeding rollers for feeding a wire to the winding tool and is controlled so that a wire feeding speed by the feeding rollers is in conformity with a wire Winding speed by the winding tool.

(3) JP-B2-6-2296 discloses a method and a device of forming a torsion coil spring by moving a forming tool between an advanced position and a retreated position axially with respect to a quill, rotating the forming tool around the axis of the quill, and causing a wire fed out through the quill proximate to a distal end face of the forming tool. In the apparatus, two large gears, one for advancing and retreating the forming tools and another one for rotating the forming tool, are arranged in parallel to each other so as to be rotatable around an axial line intersecting with the axis of the quill. The two large gears are driven by servomotors, respectively, under a command of an NC device. Each of the large gears engage with several small gears.

(4) JP-A-8-174120 discloses a wire forming apparatus in which a plurality of forming tool units are disposed on a circular table which has a surface perpendicular to a feeding direction of a wire fed out from a wire feeding guide, the forming tools being radially slidable with respect to the circular table. In the apparatus, at least one of the forming tool units is provided with a first motor for driving a cam which operates a slider carrying the forming tool unit, a tool including a pair of projections between which wire is fed, and a second motor which rotates the tool.

Each of the spring forming apparatuses disclosed in JP-B2-4-734 and JP-B2-6-2296 is designed such that a single forming tool axially moves with respect to the quill and rotates around the forward end of the quill. A wire is bent by causing the forming tool to abut the wire after rotating the forming tool. Thus, the spring forming apparatuses have not only a disadvantage that wire bending radius is restricted to a definite value but also a problem of a slow forming speed and a low productivity because of the single forming tool.

Further, the torsion spring manufacturing device disclosed in JP-B2-6-74101 is designed to perform coiling working only for a coiled portion of the torsion coil spring, thus has a problem that it is not capable of easily performing bending or curling for a hook portion of the coil torsion spring.

Furthermore, the wire forming apparatus disclosed in JP-A-8-174120, in which the first and the second motors are provided to each of the plurality of forming tool units to move the tool between the advanced position and the retreated position and to rotate the same, has a problem that, for example, according to an embodiment shown in FIG. 1, it includes shafts to be controlled along as many as eleven axes and a complicated control program for the NC device is required. In addition, the NC device must have a large control capacity and a driving motor is needed for each of the forming tool units, thereby posing a problem that the wire forming apparatus is complicated and requires an expensive manufacturing cost.

SUMMARY OF THE INVENTION

The present invention has been achieved under the technical background mentioned above.

The invention provides a spring forming apparatus which is capable of producing a torsion coil spring, a torsion spring, a tension coil spring, etc. in various shapes. The spring forming apparatus is designed such that working tools are driven by a minimum required number of drive sources so as to move between an advanced position and a retreated position and rotate, there by simplifying a control program for an NC device and a structure of the spring forming apparatus to reduce a manufacturing cost.

Accordingly there is provided a spring forming apparatus including a wire feeder unit by which a wire as a spring material is forcibly fed with utilization of at least a pair of wire feeding rollers and into a wire working region through a quill, and a plurality of separate wire working units by which the wire fed from the wire feeder unit is bent and cut to obtain a spring, wherein the plurality of wire working units are disposed radially around the axis of the quill, each of the wire working units having a slider assembly which can move perpendicularly between an advanced position and a retreated position with relation to the axis of the quill and which carries a working tool which is held by a working tool holder as a part of the slider assembly, the working tool being engageble with the wire in the wire working region when the slider assembly is positioned at the advanced position and when leaving the wire working region when the slider assembly is positioned at the retreated position, wherein the working tool holder of at least one of the wire working units is driven to rotate together with the working tool around the co-axis of the working tool holder and the working tool, the co-axis being perpendicular to the axis of the quill, wherein the spring forming apparatus further includes a wire feeding driving mechanism which drives the wire feeding rollers, a slider driving mechanism by which each of the slider assemblies is moved perpendicularly between the advanced position and the retreated position with relation to the axis of the quill, a tool rotating driving mechanism by which the working tool holder of at least one of the wire working units is driven to rotate together with the working tool around the co-axis of the working tool holder and the working tool, and a control device for operating the wire feeding driving mechanism, the slider driving mechanism and the tool rotating driving mechanism in a sequence predetermined in terms of a form of the producted spring, and wherein a volume of the wire fed through the quill, which includes a wire length or a wire feeding speed, a moving volume of a front end of the slider assembly between the advanced position and the retreated position, which includes a feeding length and a feeding speed, and a rotating volume of at least one of the working tool holders, which includes a rotational angle and a rotational speed, are controlled by the control device, whereby the wire is subjected to bending and cutting by the plurality of the working tools held by the plurality of working tool holders, respectively.

The spring forming apparatus can be provided in the following manners:

(1) The plurality of slider driving mechanisms include a driving motor for the slider assembly, a first common large gear which is driven by the driving motor for the slider assembly, a plurality of first small gears which are arranged circumferencially in engagement with the first large gear and correspond to the plurality of slider driving mechanisms, respectively, and a plurality of movement converting mechanisms by which rotational movements of the first small gears are converted into linear motions to move the slider assemblies, respectively. The driving motor for the slider assembly can be controlled with respect to a rotational speed and a rotational angle.

(2) In the embodiment of Item (1), each of the plurality of movement converting mechanisms includes a cam, a cam follower which is always kept in contact with a cam profile of the cam, and a swing arm which carriers the cam follower and pivotally moves around a pivot thereby the slider assemblies move between the advanced position and the retreated position generally perpendicularly to the axis of the quill in accordance with movement of the swing arm.

(3) In the embodiment of Item (1) or (2), at least one of the tool rotating driving mechanisms includes a driving motor for rotating the tool, a second large gear which is driven by the tool rotating driving motor for rotating the tool, at least one second small gear which is arranged in engagement with a circumference of the second large gear and corresponds to the tool rotating driving mechanism, and at least one rotational movement axially turning mechanism by which the second small gear is rotated axially to rotate the working tool holder and the working tool. The driving motor for rotating the tool can be controlled in a rotational speed and a rotational angle.

(4) In the embodiment of Item (3), at least one rotational movement axially converting mechanism includes a bevel drive gear which is rotated by the second small gear, a bevel driven gear which is in engagement with the bevel drive gear, and a rotary shaft which coaxially movably and non-rotatably passes through the bevel driven gear, and which is connected to the working tool holder, whereby the working tool holder and the working tool rotate together with the rotary shaft.

(5) In any one of the embodiments of Items (1) to (4), the first large gear for the slider driving mechanism and the second large gear for the tool rotating driving mechanism are arranged in parallel to each other between the quill and the wire feeding rollers arranged along the axis of the quill. In this case, it is possible to employ a plurality of the first and the second large gears.

(6) In any one of the embodiments of Items (1) to (5), the working tool includes a wire bending tool which has a pair of projections on the end facing a side of the wire fed the quill, the projections having a gap allowing the wire to pass through therebetween, thereby the wire positioned between the pair of projections can be bent when the wire bending tool rotates around its axis.

(7) In any one of the embodiment of Items (1) to (6) with respect to each of the plural slider driving mechanisms, each cam of the plural movement converting mechanisms can be controlled within an angle range of up to 360°.

(8) In any one of the embodiments of Items (1) to (7), the driving motor for rotating the tool for at least one tool rotating driving mechanism can be controlled so as to rotate at least one working tool holder within an angle range up to 360°.

(9) In any one of the embodiments of Items (1) to (8), the working tools are detachably held by the working tool holders.

(10) Further, the working tool holders of at least two wire working units are designed to be driven to rotate together with the working tools around axes of the working tool holders and the working tools, respectively, the axes being perpendicular to the axis of the quill.

(11) In the embodiment of Item (10), at least two tool rotating driving mechanisms include a driving motor for rotating the tools, a common second large gear which is driven by the driving motor for rotating the tools, at least two second small gears which are arranged circumferentially and in engagement with the second large gear and correspond to the at least two tool rotating driving mechanisms, respectively, and at least two rotational movement axially turning mechanisms by which the second small gears are rotated axially to rotate the working tool holders and the working tools, respectively, and the driving motor for rotating the tools can be controlled in terms of a rotational speed and a rotational angle.

In the spring forming apparatus of the invention, one or more of the wire feeding driving mechanisms, the slider driving mechanisms of the plurality of wire working units, and the tool rotating driving mechanism of at least one wire working unit are controlled in those operations by a control device according to a shape of a product. The spring forming apparatus has three drive sources and each driving mechanism is operated with a single drive source. Specifically, all of the slider driving mechanisms for a plurality of wire working units and the tool rotating driving mechanism for at least one wire working unit as well as the wire feeding driving mechanism are operated, respectively, by a single drive source. When the wire feeding driving mechanism is operated, at least a pair of wire feeding rollers rotate and the wire is fed out through a quill. When the slider driving mechanism operates, the slider assembly moves between the advanced and the retreated positions together with the working tool holder and the working tool carried by the slider assembly. When the tool rotating driving mechanism is operated, the working tool holder and the working tool rotate around the axis.

A volume of the wire fed through the quill by the wire feeding driving mechanism, a moving volume of a front end of each slider assembly driven by the sliding deplacement driving mechanism and a rotating volume of each working tool holder driven by the tool rotating driving mechanism are controlled by the control device, whereby the wire is subjected to bending and cutting by the plurality of the working tools held by the plurality of working tool holders, respectively.

Similar reference characters denote corresponding features consistently throughout the attached drawings in which:

DETAILED DESCRIPTION OF PREFERRED EMBODIMENTS

Now, description will be made of an embodiment of the spring forming apparatus according to the present invention.

Figure 1:
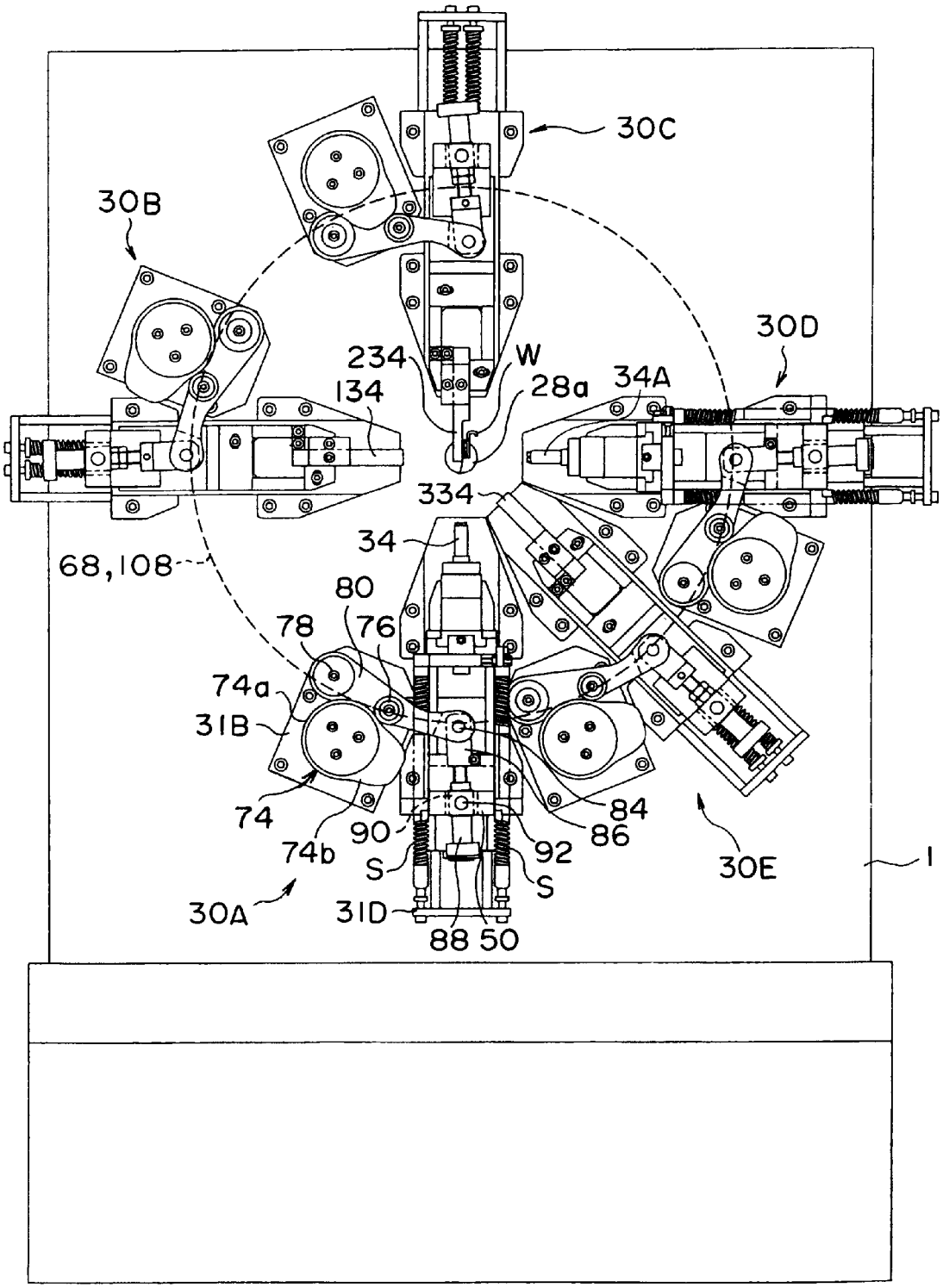
FIG. 1 is a front view of a preferred embodiment of a spring forming apparatus according to the present invention.
Figure 2:
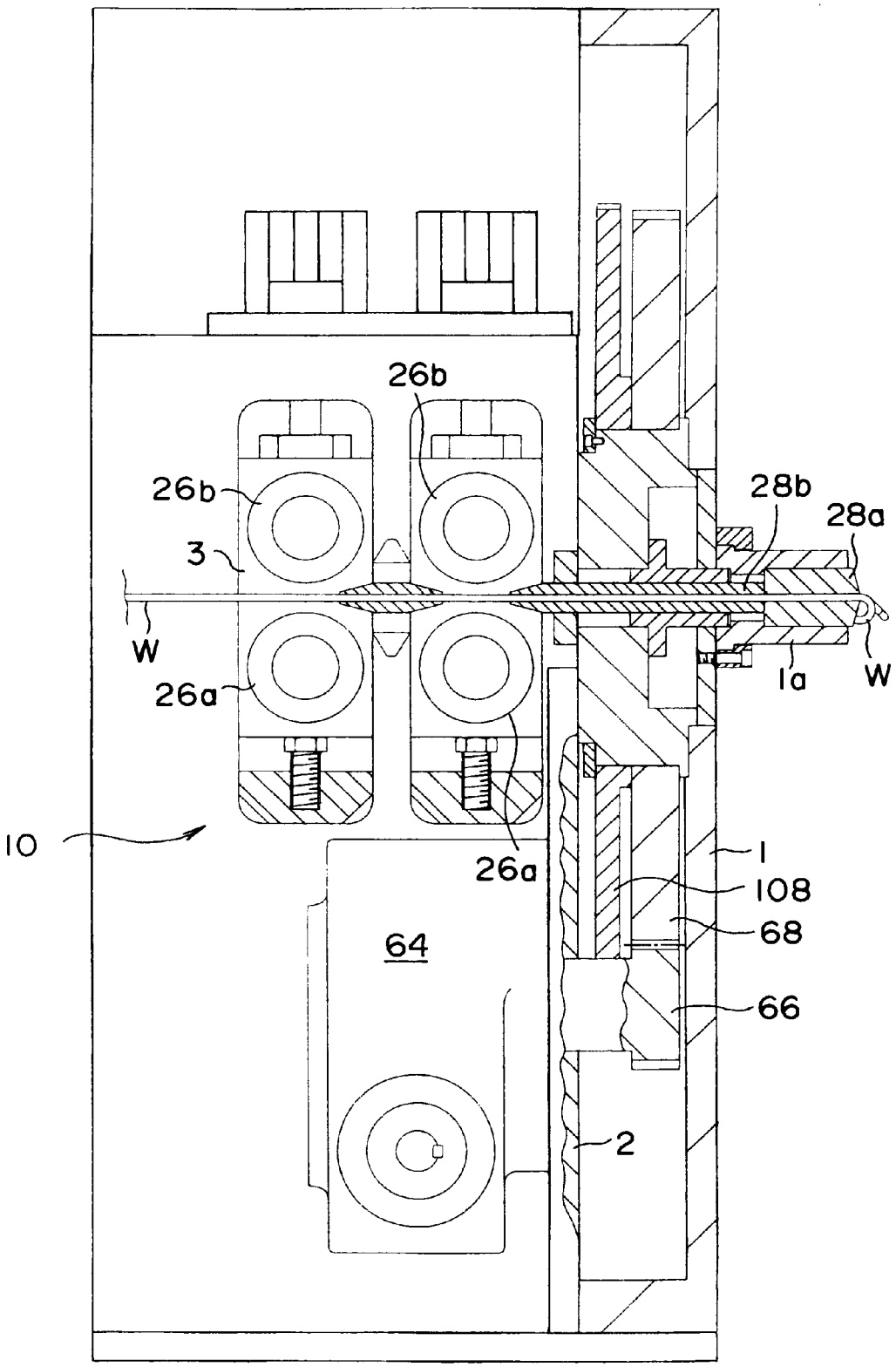
FIG. 2 is a side view, partially in cross section of the spring forming apparatus shown in FIG. 1.
Figure 3:
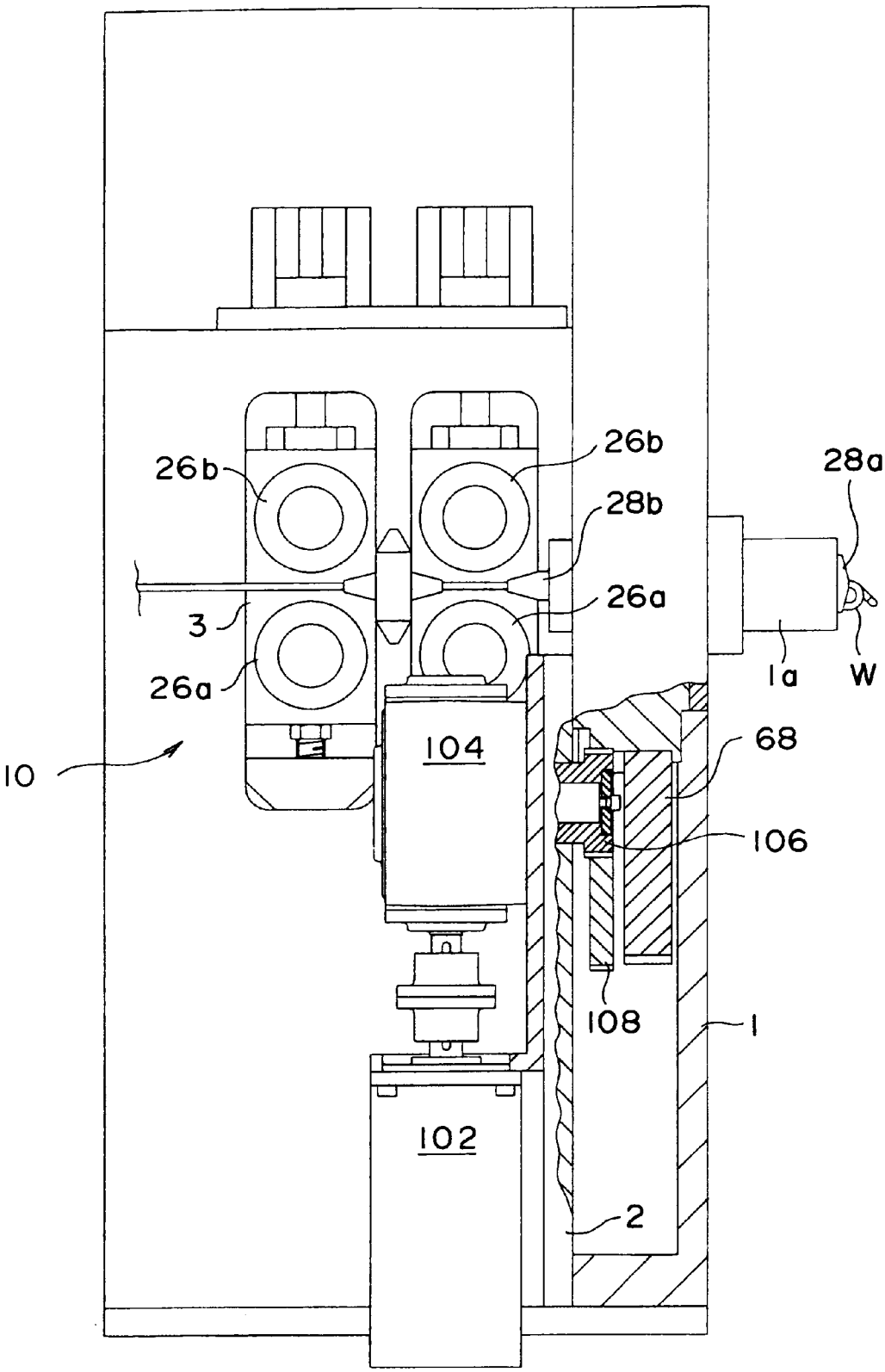
FIG. 3 is a side view, partially in cross section of the spring forming apparatus shown in FIG. 1.
Figure 4:
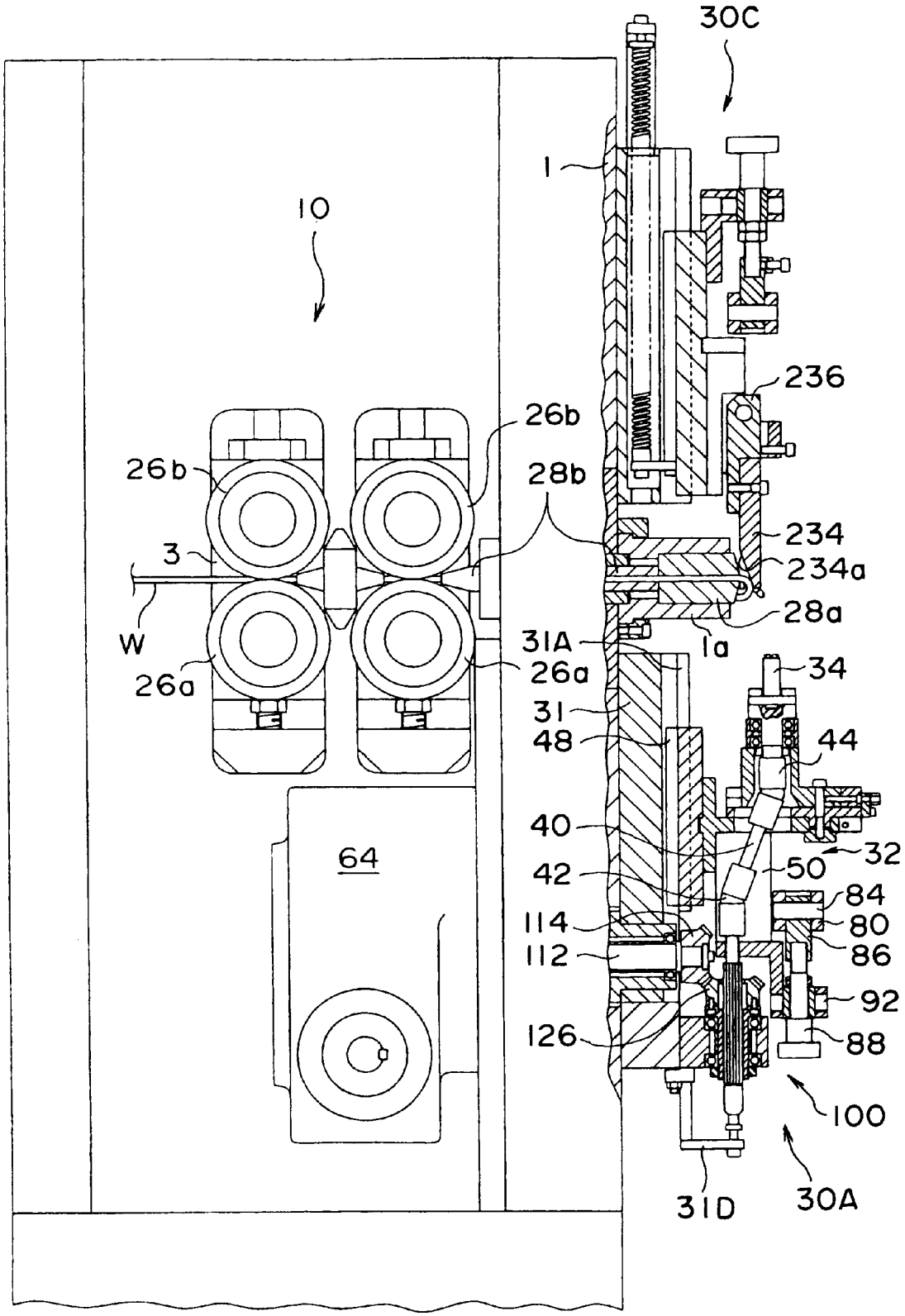
FIG. 4 is a side view, partially in cross section of the spring forming apparatus shown in FIG. 1.

FIG. 1 is a front view of one embodiment of a spring forming apparatus according to the invention. The spring forming apparatus includes five separate wire working units 30A, 30B, 30C, 30D and 30E. The wire working unit 30A is a bending unit, 30B a backup mandrel core unit, 30C a coiling unit, 30D another bending unit and 30E a cutting unit. These units are mounted in front of a front base frame panel 1 in a vertical position and arranged radially around a wire feeding axis (described later) as a center, the front base frame panel being fixed on a bed frame. On a side of a rear surface of the front base frame panel 1, there are disposed primary components of a wire feeder unit 10 including wire feeding rollers 26*a* and 26*b* (FIGS. 2 to 5), and all driving units. However, only a wire feeding quill (or a wire guide cylinder) 28*a,* through which a wire is fed out, is a part of the wire feeder unit 10, disposed so as to protrude from the front surface of the front base frame panel 1 (FIGS. 2 to 4).

A detail of the wire feeder unit 10 and the wire working units 30A to 30D will be described below. Since the wire working units 30A to 30D have substantially the same structure as to one another, only the wire working unit (bending unit) 30A is described here. However, it should be noted that the wire working units (backup mandrel) 30B, the wire working unit (coiling unit) 30C and the wire working unit (cutting unit) 30E are different from the other wire working units (bending unit) 30A and 30D in that the former group does not have tool rotating mechanisms 100 and includes different working tools.

Referring to FIGS. 2–5 wire feeder unit 10 is disposed, together with its driving unit, in a space behind the front base frame panel 1. The wire feeder unit 10 has two pairs of upper and lower wire feeding rollers 26*b* and 26*a*. The wire feeding rollers 26*a* and 26*b* are fixed on ends of roller shafts 20*a* and 20*b,* respectively, which are rotatably supported by a machine frame 3 of the wire feeder unit 10 by bearings 22*a,* 22*b,* 24*a* and 24*b*. Gears 18*a* and 18*b,* which are in engagement with each other for each pair of the rollers, are mounted in the vicinities of the other ends of the roller shafts 20*a* and 20*b* so that the gear 18*a* for each pair of rollers is in engagement with a wire feeding drive gear 16 which is driven by a wire feeding servomotor 12 via a reduction worm gear mechanism 14, thereby rotating both the roller shafts 20*a* and 20*b*.

Further, a wire guide 28*b* is disposed through the front base frame panel 1, and the wire feeding quill 28*a,* which is held by a quill holder sleeve 1*a* fixed to the front base frame panel 1, is arranged in series with the wire guide 28*b* to guide a wire W to be worked from the location of the wire feeding rollers 26*a* and 26*b* to a location (a wire working region) outside the front base frame panel 1.

The wire W to be worked is drawn out by a drawing force of the wire feeding rollers 26*a* and 26*b* from a wire supply source (not shown) (e.g. a wire coil wound on an uncoiler) via a leveller (not shown) or a wire straightener (not shown). A wire feeding force (driving force) of the wire feeding rollers 26*a* and 26*b* is given by the wire feeding servomotor 12.

Figure 6:
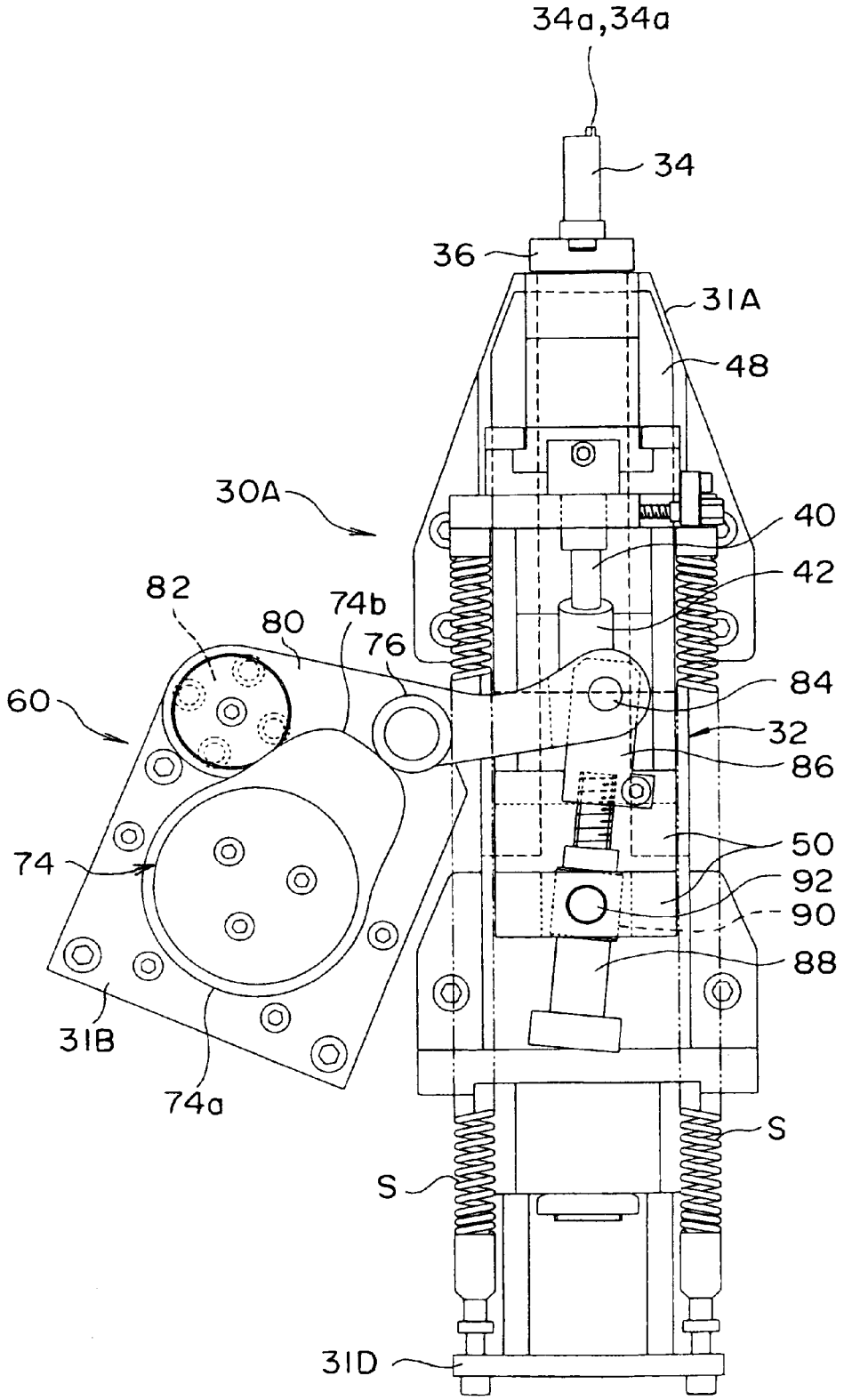
FIG. 6 is a front view of a wire bending unit of the spring forming apparatus shown in FIG. 1.
Figure 7:
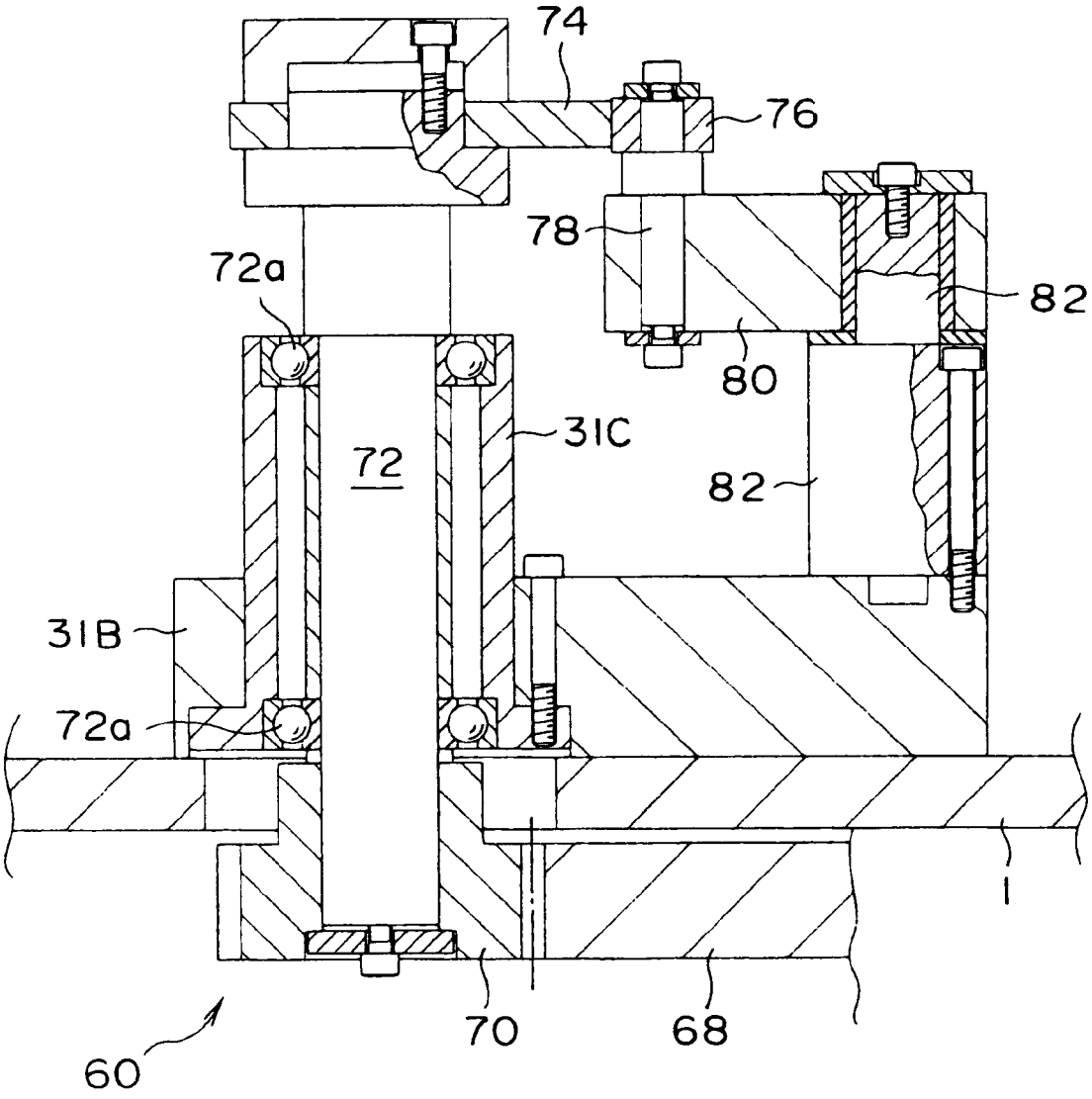
FIG. 7 is a top view, partially in cross section, of a cam mechanism of a slider driving mechanism of the wire working unit shown in FIG. 6.
Figure 8:
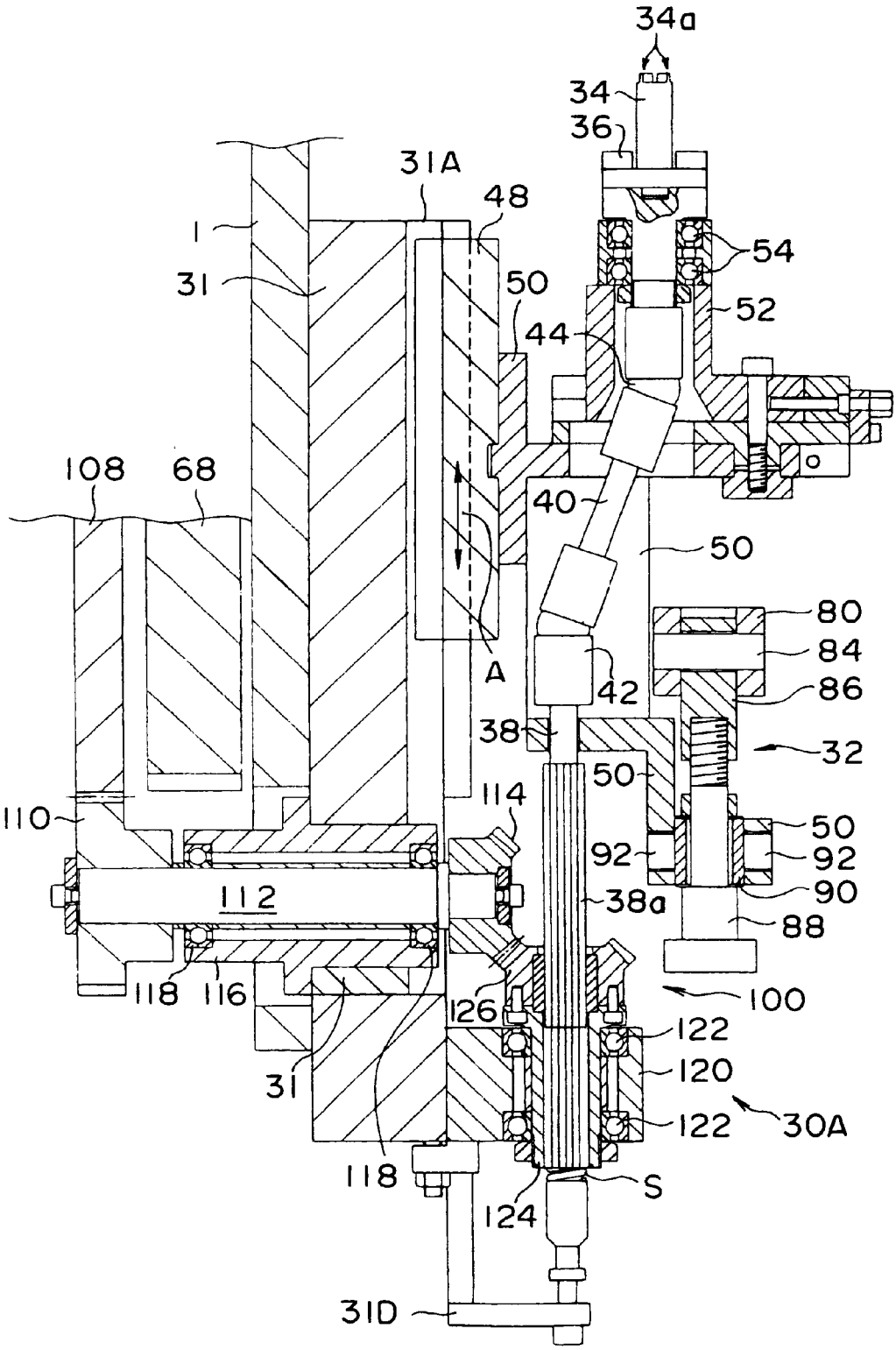
FIG. 8 is a side view, partially in cross section, of the slider driving mechanism and a tool rotating driving mechanism of the wire working unit shown in FIG. 6.

Referring to FIGS. 1, 4 and 6–8, wire working unit (bending unit) 30A is fixed, together with the other wire working units 30B to 30E, on an outer surface of the front base frame panel 1 in the vertical position. FIG. 6 is front view of the wire working unit (bending unit) 30A, and side views of the wire working unit (bending unit) 30A are shown in FIGS. 4 and 8, which are observed from a direction parallel to the front base frame panel 1.

The wire working unit (bending unit) 30A includes a slider assembly 32 which moves between an advanced and a retreated position in a direction approximately perpendicular to the axis of the wire feeding quill 28*a* and which carry a bending tool 34 having a shape of a round bar (working tool), a slider driving mechanism 60 to advance and recede the slider assembly 32, a tool rotating driving mechanism 100 to rotate the bending tool 34 around the axis thereof, a servomotor 62 (FIG. 5) for the slider driving mechanism 60, and a servomotor 102 (FIG. 3) for the tool rotating driving mechanism 100.

The bending tool 34, by which the wire W is bent, is provided with a pair of protruding elements 34*a*, 34*a*, having small gap therebetween, on the distal end thereof, and is detachably retained by a working tool holder 36.

A description will be made below of working tools which are held by the working units other than the wire working unit (bending unit) 30A. A backup mandrel 134 which is held by the wire working unit (backup mandrel unit) 30B is a member for defining a coiling diameter at a stage to coil the wire W and is a working tool which is brought into contact with a curved inner circumference of the coiled portion which is shaped in the space between the quill 28*a* and a coiling tool 234 described later. A coiling tool 234 which is held by the wire working unit (coiling unit) 30C is a tool to form a coil body portion of a coil spring, has a slanted surface 234*a* shaped to face to the front end of the wire feeding quill 28*a* as shown in FIG. 4 and is held by a working tool holder 236. A bending tool 34A which is held by the wire working unit (another bending unit) 30D is a tool similar to the bending tool 34 held by the wire working unit (bending unit) 30A described above. A cutting tool 334, which is held by the wire working unit (cutting unit) 30E, is a tool for cutting off a coil spring from the wire W after completing bending and coiling and has a cutting blade on the front end thereof, and by which the wire W is cut by a shearing force or shearing force in cooperation with the front end of the wire feeding quill 28*a*.

A working tool holder 36 is rotatably supported by bearings 54, 54 mounted on an end of a cylindrical body 52 which is a member of the slider assembly 32 located on a side of a base frame 50. Further, rotary shafts 38 and 40 including universal joints 42 and 44 are connected to the rear end of the working tool holder 36. The rotary shaft 38 includes a splined shaft 38*a* which extends along the almost entire length of the rotary shaft 38 and which passes through a splined nut 124, described later, in axially movably spline engagement with each other. Such structure assures movements of the bending tool 34 and the working tool holder 36 together with the slider assembly 32.

The slider assembly 32 has a base of a slider (sliding member) 48 which is mounted on a guide member 31A being fixed on the front base frame panel 1 through a base plate 31 slidably supported by the guide member 31A (see arrows A in FIG. 8). Accordingly, the bending tool 34 advances and recedes together with the working tool holder 36 as the slider 48 moves, and rotates as the rotary shafts 38 and 40 rotate.

Now, a description will be made of the slider assembly 32, the slider driving mechanism 60 and the tool rotating driving mechanism 100.

Referring to FIGS. 2 and 5–8, slider driving mechanism 60 includes a first large drive gear 68 which is disposed along the backside surface of the front base frame panel 1, a first small driven gear 70 which is in engagement with outer circumferential gear teeth of the first large drive gear 68, a cam shaft 72 having an end on which the first small driven gear 70 is fixed and a cam 74 which is fixed on the other end of the cam shaft 72. The cam 74 has a circular cam profile 74*a* and a protruding cam profile 74*b*. The cam shaft 72 is rotatably supported, by bearings 72*a* and 72*a*, by a cylinderical shaft 31C protruding through a generally rectangular base plate 31B which is directly fixed on the outer surface of the front base frame panel 1.

In addition to the first small driven gear 70, a first small drive gear 66 and a plurality of first small driven gears (not shown) for the other wire working units 30B to 30E are in engagement with the outer circumferential gear teeth of the first large drive gear 68. Each of the first small driven gears has an axis as a rotational center thereof which is in alignment with the axis of a cam of each wire working unit. The first small drive gear 66 is driven by a servomotor 62 for the slider driving mechanism via a reduction worm gear mechanism 64, thereby rotating the first large drive gear 68 and the first small driven gear 70.

The slider driving mechanism 60 has a cam follower 76 which is in engagement with the cam 74, a swing arm 80 which rotatably supports the cam follower 76 generally in the middle of the swing arm 80 on a shaft 78, and a pivot 82 which is fixedly mounted on a rectangular base plate 31B and rotatably supports the swing arm 80 at one end thereby. A connecting pin 84 is attached to a forked portion at the other end of the swing arm 80 and a connecting rod 86 is pivotably supported by the connecting pin 84. The connecting rod 86 has internal threads at its free end with which an external-thread bolt 88 is screwed with the connecting rod 86. The male threaded bar 88 is fixedly fitted in a sleeve 90 which is also fitted in a hole at an end of the base frame 50. The sleeve 90 has stop bolts 92, 92 which are integrally formed with the sleeve 90 and rotatably fitted in bearing support of the base frame 50. The coincident axes of the stop bolts 92, 92 are parallel to the axis of the connecting pin 84, whereby when the swing arm 80 pivotably rotates, the connecting rod 86 and the sleeve 90 pivotably rotate thereby the external-thread bar 88 fitted in the sleeve 90 also pivotably moves. When these members pivotably move, the base frame 50 advances and recedes along the axis of the working tool with a slidingly engaged relationship between the slider 48 and a guide member 31A, thereby the working tool holder 36 and the bending tool 34 advance and recede along the axis thereof.

A pair of tension coil springs S, S are mounted between the base frame 50 of the slider assembly 32 and the base frame 31D of the wire working unit (bending unit) 30A so that the base frame 50 retreats to withdraw the bending tool 34, thereby the swing arm 80 rotates clockwise around the pivot 82 (FIG. 6) such that the cam follower 76 which is supported by the swing arm 80 is urged toward to the outer circumferential cam profile of the cam 74. When the protruding cam face 74*b* of the cam 74 pushes the cam follower 76, the base frame 50 is advanced against the biasing force of the tension coil springs S, S.

Figure 5:
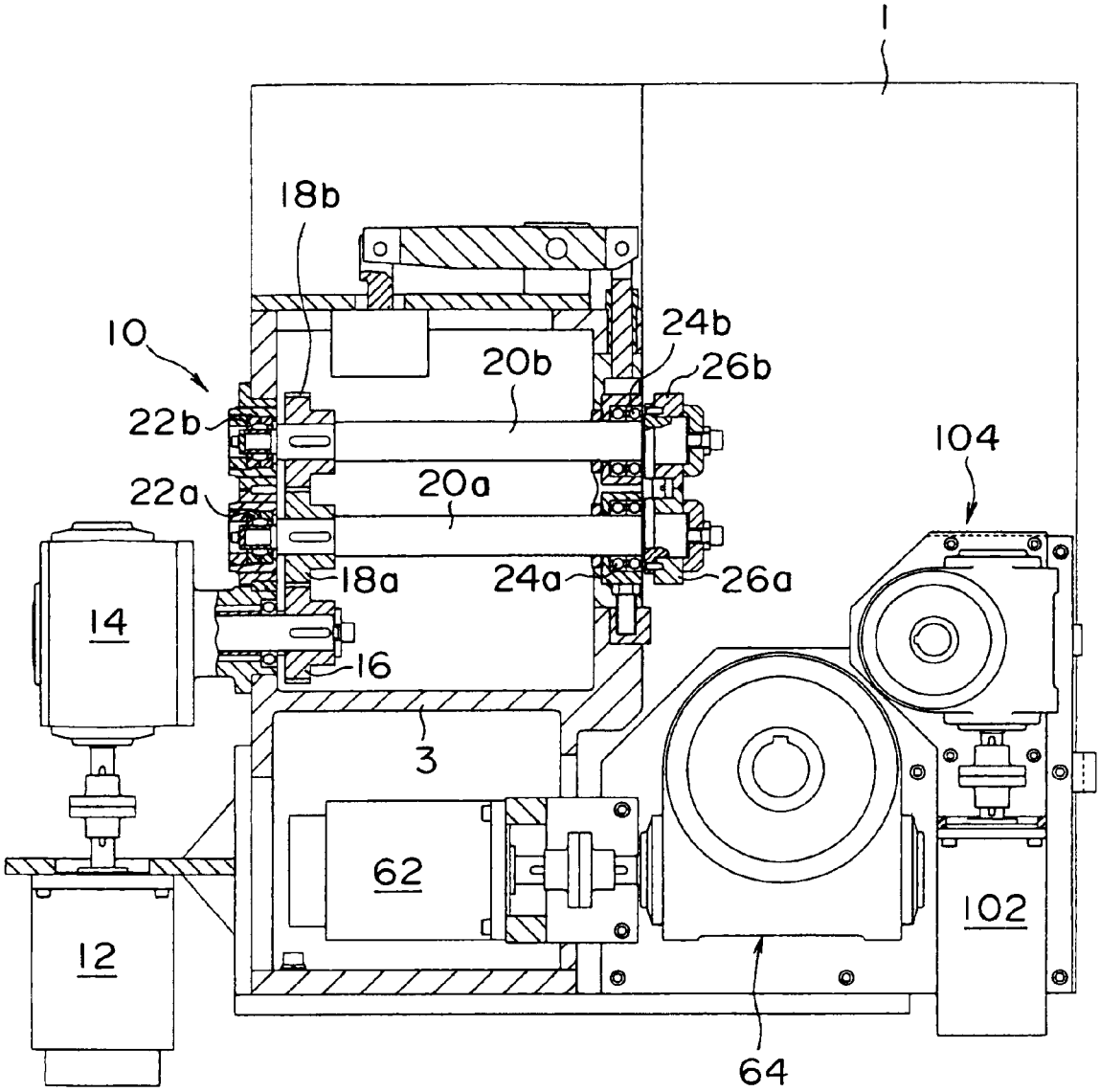
FIG. 5 is a rear view, partially in cross section, of the spring forming apparatus shown in FIG. 1.

Referring to FIGS. 3, 5 and 8, the tool rotating driving mechanism 100 includes a second large drive gear 108 which is disposed at the back of the first large drive gear 68 being disposed along the backside surface of the front base frame panel 1 and which is parallel and coaxial to the first large drive gear 68, a second small driven gear 110 which is in engagement with outer circumferential gear teeth of the second large drive gear 108, a rotary shaft 112 having an end which is fixed to the second small driven gear 110 and the other end fixed to a drive bevel gear 114, and a cylindrical shaft 116 which is mounted fixedly through the base plate 31 and by which the rotary shaft 112 is supported by bearings 118, 118.

Further, the tool rotating driving mechanism 100 includes a housing 120 mounted on the base plate 31, a splined nut 124 which is rotatably and axially-immovably mounted in a through hole of the housing 120 by bearings 122, 122, and a driven bevel gear 126 which is fixed to one end of the splined nut 124. The follower side bevel gear 126 is in engagement with the drive bevel gear 114, and the splined nut 124 is in splined engagement with a splined shaft 38*a* for rotation therewith.

In addition to the second small driven gear 110, a second small drive gear 106 and a second small driven gear (not shown) for the other wire working unit (bending unit) 30D, except for wire working units 30B, 30C and 30E, are in engagement with the outer circumferential gear teeth of the second large drive gear 108. The second small drive gear 106 is driven by a servomotor 102 for the tool rotating driving mechanism via a reduction worm gear mechanism 104, thereby rotating the second large drive gear 108 and the second small driven gear 110.

The following is a sequence of power transfer system from the second small driven gear 110 to the working tool holder 36. The bending tool 34 is rotated by a driving force which is transmitted to the working tool holder 36 through a course of the second small driven gear 110 to the rotary shaft 112 to the drive bevel gear 114 to the driven bevel gear 126 to the splined nut 124 to the rotary shaft 38 (spline shaft 38*a*) to the universal joint 42 to the rotary shaft 40 to the universal joint 44 to the working tool holder 36.

While there are described above the particulars of the wire feeder unit 10 and the wire working unit (bending unit) 30A, a general power transfer system of the spring forming apparatus is controlled by a single NC unit (not shown). Particularly, the wire feeder unit 10 and each wire working units 30A to 30E are operated or driven by three sets of servomotor: (a servomotor 12 for wire feeding, a servomotor 62 for the slider driving mechanism and a servomotor 102, which is not effect to the wire working unit 30B, 30C and 30E, for the tool rotating driving mechanism) whose rotational speeds and rotational angles can be controlled so as to realize predetermined operational relationships among the units.

The servomotor 62 for the slider driving mechanism is controlled by the NC device so as to rotate each cam of each wire working units 30A to 30E within a predetermined angle range of up to 360°. When the servomotor 102 for the tool rotating driving mechanism is actuated, the working tool holder 36 of the wire working units (bending unit) 30A and 30D are rotated, however, at working steps other than the bending step, the slide assemblies 32 of the working units (bending unit) 30A and 30D are at those retreated positions, thus the working tools are also at those retreated positions with respect to the wire working region.

Now, a description will be made of operations of the spring forming apparatus.

Referring to FIGS. 4 and 5, when the servomotor 12 for wire feeding is actuated with a command of the NC device, its rotating force is transmitted to the gear 18*a* of each pair of rollers through the reduction worm gear mechanism 14 and the wire feeding drive gear 16, and all the roller shafts 20*a* and 20*b* are rotated according to the relationship between the gears 18*a* and 18*b*, thereby the wire feeding rollers 26*a* and 26*b* are rotated. The wire W to be worked, which is drawn out from a wire supply source (not shown) and previously positioned between the wire feeding rollers 26*a* and 26*b*, is forcibly transferred toward the wire working region located outside the front base frame panel 1 via the wire guide 28*b* and the wire feeding quill 28*a*, or retreated when the servomotor 12 for wire feeding rotates in the reverse direction.

Referring to FIGS. 2 and 5–8, the servomotor 62 for the slider driving mechanism 60 is actuated with a command of the NC device, its rotating force is transmitted to the first large drive gear 68 through the reduction worm gear mechanism 64 and the first small drive gear 66. When the first large drive gear 68 rotates, the first small driven gear 70 rotates together with the cam shaft 72, thereby the cam 74 which is mounted at the end of the cam shaft 72 is rotated clockwise (FIG. 6). A rotating force of the cam 74 is transmitted to the cam follower 76 which is always urged against the profile of the cam 74 under the biasing force of the tension coil springs S, S, the cam follower 76 moves in accordance with the cam profile, the swing arm 80 pivotably rotates counterclockwise (FIG. 6) around the pivot 82, and the rotating force is transmitted to the base frame 50 of the slider assembly 32 through a course of the connecting pin 84 to the connecting rod 86 to the external-thread bolt 88 to the sleeve 90 to the stop bolt 92 to the base frame 50. Consequently when the cam follower 76 is pushed by the protruding cam profile 74*b* of the cam 74, the slider assembly 32 advances, thereby the bending tool 34 which is supported by the working tool holder 36 moves toward the wire working region with a slidingly engaged relationship between the slider (sliding member) 48 and the guide member 31A mounted on the front based frame panel 1. When the cam 74 is further rotated by a command of the NC device until the circular cam profile 74*a* comes into contact with the cam follower 76, while the swing arm 80 pivotally rotates in the reverse direction and the slider assembly 32 moves toward the retreated position and the bending tool 34 supported by the working tool holder 36 moves backwardly from the wire working region.

Referring to FIGS. 3, 5 and 8, when the servomotor 102 for the tool rotating driving mechanism 100 is actuated with a command from the NC device, its rotating force is transmitted to the second large drive gear 108 through the reduction worm gear mechanism 104 and the second small drive gear 106. When the second large drive gear 108 rotates, the second small driven gear 110 which is in engagement with this large gear is rotated and the drive bevel gear 114, which is mounted at the other end of the rotary shaft 112 opposite to the second small driven gear 110, is rotated. A rotating force of the drive bevel gear 114 is transmitted to the working tool holder 36 through a course of the driven bevel gear 126 to the splined nut 124 to the rotary shaft 38 (spline shaft 38*a*) to the universal joint 42 to the rotary shaft 40 to the universal joint 44, thereby the bending tool 34 is rotated. The bending tool 34 can be rotated in normal and reverse direction with a command of the NC device.

Now, a description will be made of working modes with respect to forms of formed wire product.

The bending tool 34 is advanced into the wire working region by moving the slider assembly 32, then the wire is fed into the wire working region by operating the wire feeder unit 10, and the wire is inserted between the pair of protruding elements 34*a*, 34*a* of the bending tool 34. Such wire insertion can be performed in an optional sequence of an operational combination of the slider assembly 32 and the wire feeder unit 10.

Then, the wire is bent by operating the slider driving mechanism 60 so as to axially rotate the bending tool 34 at an angle corresponding to a bending angle desired for the wire. The bending operation can be performed by optionally selecting both or either of the wire working unit (bending unit) 30A and the wire working unit (bending unit) 30D according to a desired bent form of the wire W (a form having a single or plurality of bent portions).

To form a wire into a hemicircular shape, the working tool 234 (coiling tool) having the slanted working surface is advanced into the wire working region by moving the slider assembly of the wire working unit (coiling unit) 30C. Then, the wire W is fed into the wire working region until it abuts the slanted working surface of the working tool 234 by operating the wire feeder unit 10. The wire W, which is urged against the slanted working surface, is continuously advanced until it becomes hemicircular while being curved at a radius corresponding to an advancing angle of the wire relative to the slanted working surface (FIG. 4).

Alternately, it is possible to curve the wire into a hemicircular shape with the bending tool 34 in an operating sequence like as that above.

To curve a section of wire, other than the end, into a circular form, the wire feeder unit 10 is operated and the wire is fed until its desired section or region to be curved is brought into the wire working region. Then, the bending tool 34 is advanced into the wire working region by moving the slider assembly 32, and the wire is inserted between the pair of protruding elements 34*a* and 34*a* (preferably, one of the protruding elements 34*a* is generally in alignment with the rotational center of the bending tool 34) of the bending tool 34. Then, the wire W can be curved into a hemicircular shape by rotating the bending tool 34 by a predetermined angle. The bending operation can be performed by optionally selecting both or either of the wire working unit (bending unit) 30A and the wire working unit (bending unit) 30D according to a desired bent form of the wire W (a form having a single or plurality of bent sections).

To form a hook at any end of a wire, after a hook shape portion is formed, a wire W is fed into the wire working region for a length according to a leg by operating the wire feeder unit 10 and another section of the wire W to be shaped secondarily is fed into the wire working region.

To coil a wire, the working tool (coiling tool) 234 having the slanted working surface is advanced into the wire working region by moving the slider assembly of the wire working unit (coiling unit) 30C. Then, the wire W is fed continuously into the working region until it abuts against the slanted working surface of the working tool 234 by operating the wire feeder unit 10. At this time, the backup mandrel 134 which is a working tool 234 of the wire working unit (backup mandrel) 30B also advances and is brought into the wire working region immediately after wire is fed from the quill 28*a* from inside the direction of the curved surface of the wire W, thereby performing a backup function which defines a coil diameter.

Figure 9:
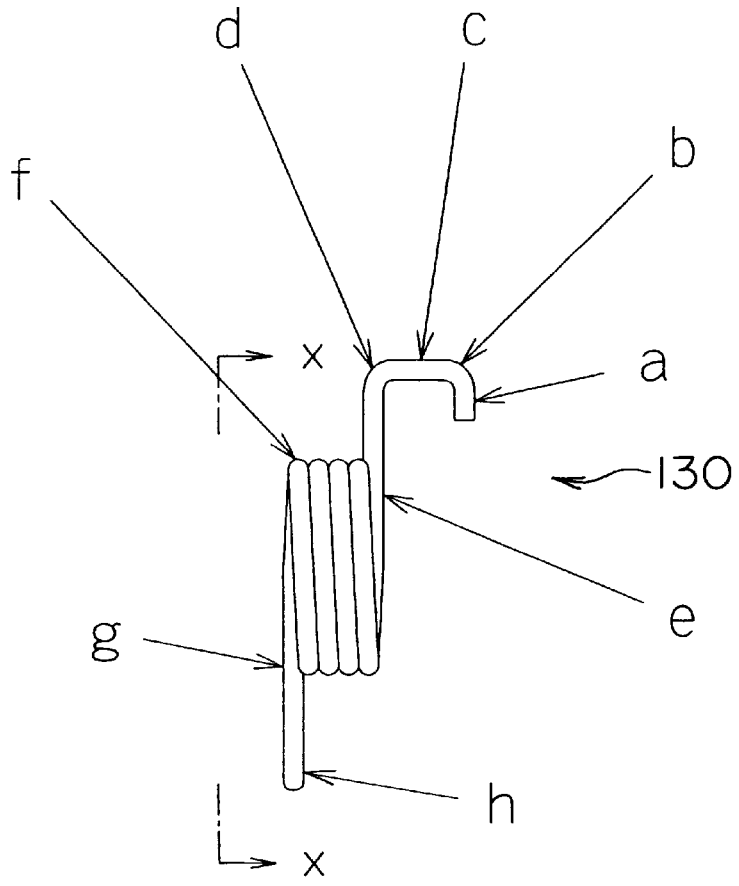
FIG. 9 is a side view one embodiment of of a product coil spring.
Figure 10:
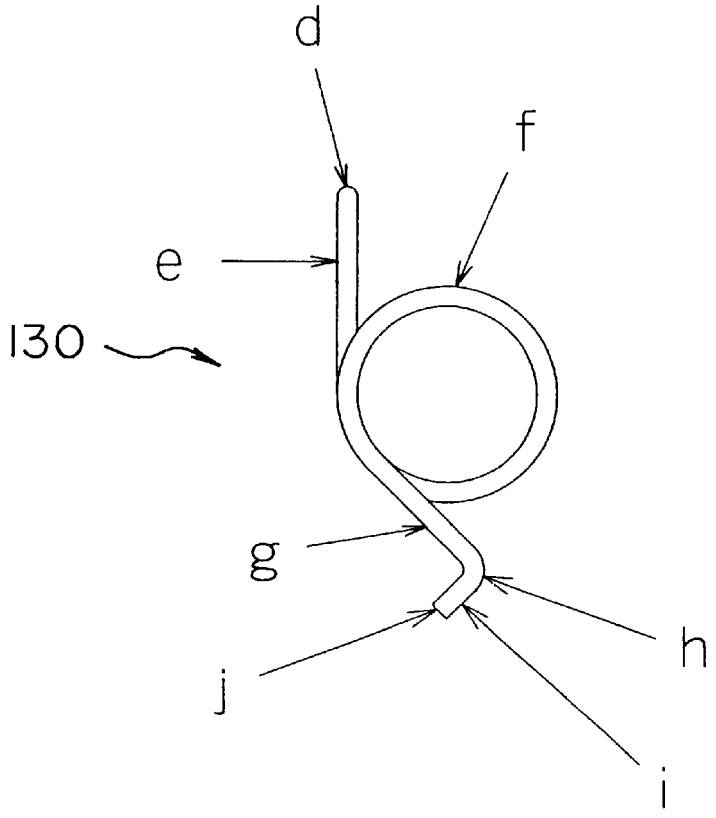
FIG. 10 is an end view of the coil spring observed from the direction indicated by arrows X—X in FIG. 9.

Now, particulars will be described of specific procedures of forming a torsion coil spring 130 shown in FIGS. 9 and 10 with the spring forming apparatus of the invention with reference to FIGS. 11 to 25.

Figure 11:
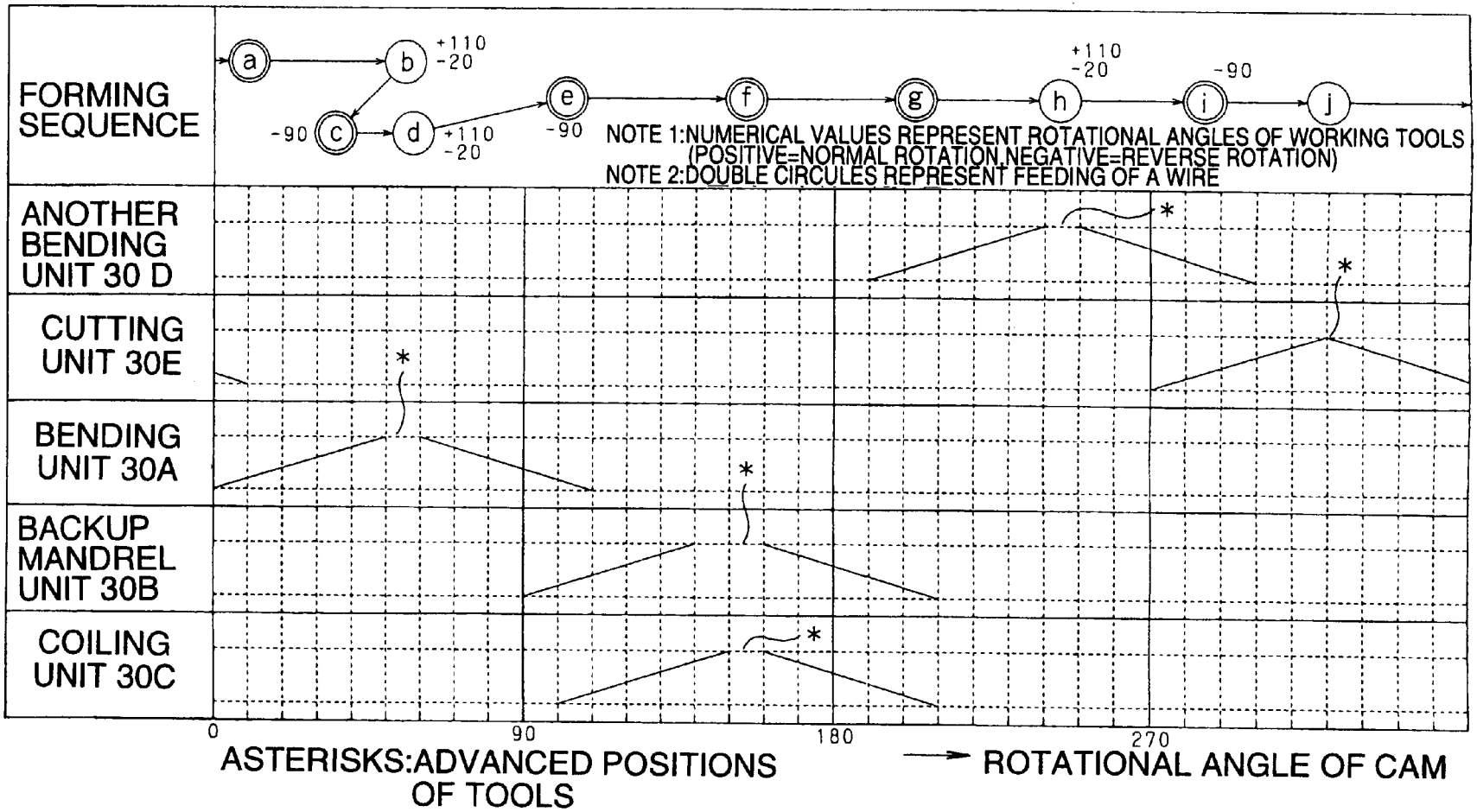
FIG. 11 is a graphical representation of a relationship between a rotating angle of a cam (abscissa) and a position of a working tool (ordinate; an asterisk indicates a most advanced position) of each wire working unit, correspondence between rotating angles of cams and formation steps (circled alphabetic characters on the uppermost line indicate forming steps and correspond to alphabetic characters shown in FIGS. 12 through 25) and wire feeding operations from a wire feeding quill (double circled alphabetic characters on the uppermost line indicate forming steps)
Figure 12:
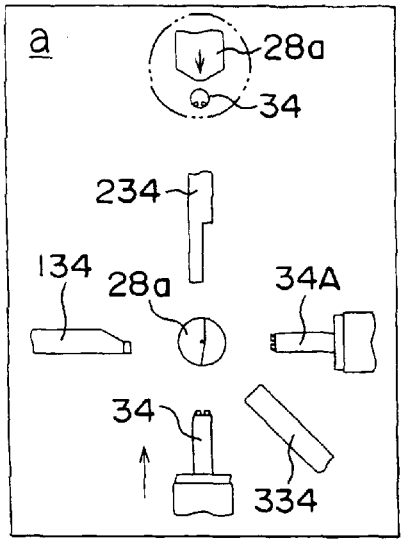
FIG. 12 is a schematic diagram showing a forming step a, or illustrating conditions of an end surface of the wire feeding quill and each wire working unit as seen in a direction along the axial line of the wire feeding quill (corresponding to FIG. 1), and schematically showing, within a circle or a phantom double-dashed line, conditions of a tip side surface of the wire feeding quill and tip surface of the working tools as seen in a direction in parallel with a surface of a front base frame panel.

FIG. 11 shows a) a relationship between rotational angles (abscissa) of the cams of each wire working units 30A through 30E and positions of the working tools (ordinate; asterisks indicate most advanced positions of the working tools), b) a correspondence between the rotational angles of the cams and forming steps (circled alphabetic letters on the uppermost line indicate the forming steps and correspond to those shown in FIGS. 9, 10 and 12 through 25), and c) wire feeding out operations from the wire feeding out quill 28*a* (double circled alphabetic letters on the uppermost line indicate the forming steps).

Further, FIGS. 12 to 25 illustrate conditions of an end surface of the wire feeding quill 28*a* and the wire working units as seen in a direction along the axial line (corresponding to the conditions shown in FIG. 1), and schematically show, within circles or ellipses traced in phantom lines, conditions of a tip side surface of the wire feeding quill 28*a* and tip end surfaces of the working tools as seen in a direction in parallel with the surface of the front base frame panel 1. The forming steps will be described in sequence below:

(1) Forming step "a" (FIG. 12): This step corresponds to a straight part "a" of the torsion coil spring 130 shown in FIGS. 9 and 10. The bending tool 34 of the wire working unit (bending unit) 30A is advancing (see the rising oblique line on the unit (bending unit) 30A line located under the double circled "a" on the forming step line in FIG. 11) and a wire W is about to be fed from the wire feeding quill 28*a*. At this time, the wire working units 30B through 30E other than each wire working unit (bending unit) 30A are set at retreated positions.

Figure 13:
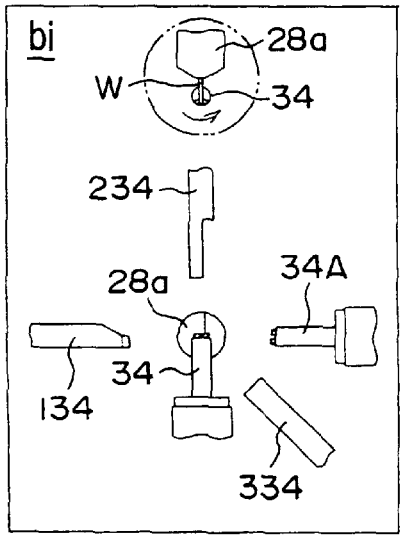
FIG. 13 is a diagram similar to FIG. 12, but showing an initial forming step "$b_i$"
Figure 14:
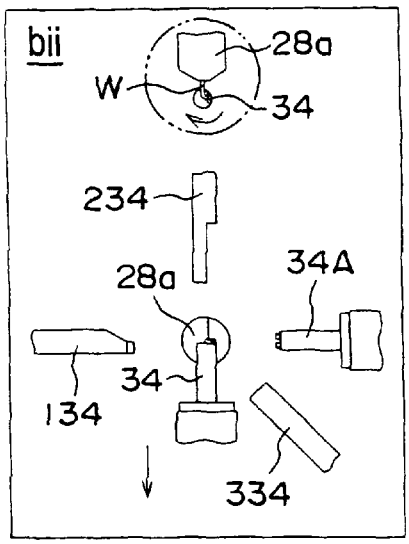
FIG. 14 is a diagram similar to FIG. 12, but showing a latter forming step "$b_{ii}$"
Figure 15:
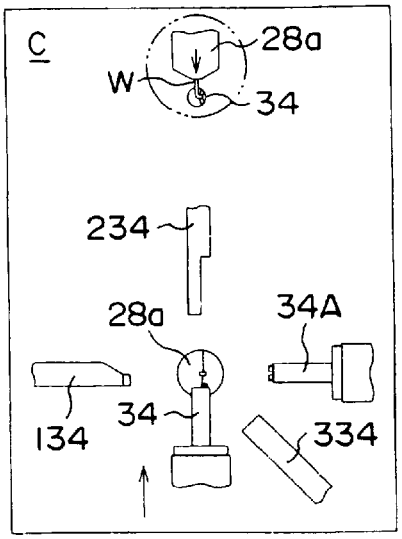
FIG. 15 is a diagram similar to FIG. 12, but showing a forming step "c"

(2) Forming step "b" (FIGS. 13 and 14): This step corresponds to a bent part "b" of the torsion coil spring 130 shown in FIGS. 9 and 10. The bending tool 34 of the wire working unit (bending unit) 30A is set at an advanced position, and the wire W is fed out from the wire feeding quill 28*a* and positioned between the pair of protruding elements 34*a* and 34*a* of the bending tool 34 in step $b_i$ as shown in FIG. 13. In this condition, the rising oblique line on the unit (bending unit) 30A line located under the circled "b" has completed rising (see the asterisk) and the bending tool 34 is set at a most advanced position as shown in FIG. 11. Thereafter, the bending tool 34 rotates 110° in the normal direction (see +110 added on the right side of the circled "b" on the forming sequence line in FIG. 11 and the diagram shown within the circle traced in a phantom line in FIG. 13), then rotates 20° in the reverse direction in step $b_{ii}$ as shown in FIG. 14 (see −20 added on the right side of the circled "b" on the forming sequence line in FIG. 11 and the illustration shown within the circle traced in a phantom line in FIG. 14. The rotations of +110° and −20° have been selected taking into consideration a spring back amount due to elastic deformation caused by bending the wire 90°), and the bending tool 34 retreats (see correspondence between the rising oblique line on the bending unit 30A line and the double circled "c" in FIG. 11 and FIG. 14).

(3) Forming step "c" (FIG. 15): This step corresponds to a straight part "c" of the torsion coil spring 130 shown in FIGS. 9 and 10. The wire W is fed out (see the double circled "c" on the forming sequence line in FIG. 11), and the bending tool 34 advances and rotates 90° in the reverse direction (See −90 added on the left side of the double circled "c" on the forming sequence line in FIG. 11. In this condition, the bending tool 34 is set at the initial rotating angle.).

Figure 16:
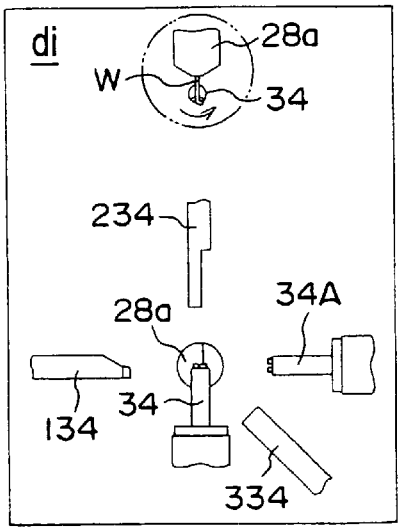
FIG. 16 is a diagram similar to FIG. 12, but showing an initial forming step "$d_i$"
Figure 17:
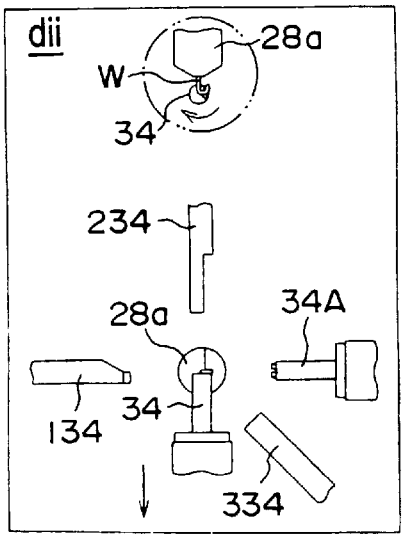
FIG. 17 is a diagram similar to FIG. 12, but showing a latter forming step "$d_{ii}$"
Figure 18:
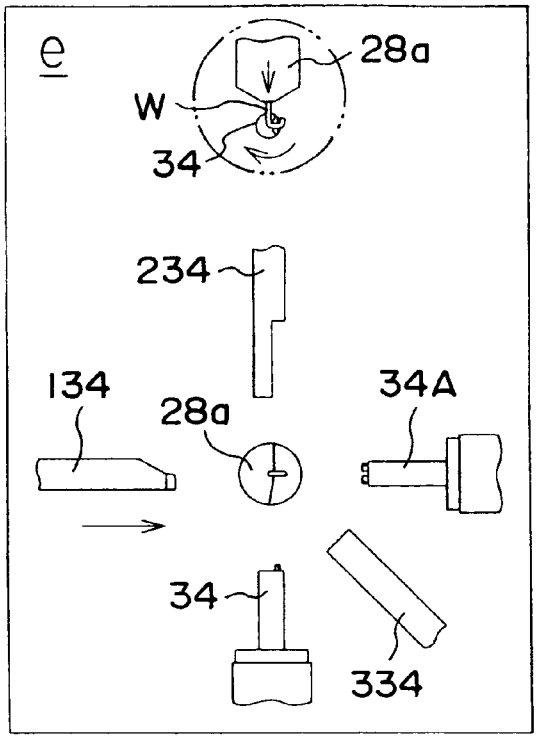
FIG. 18 is a diagram similar to FIG. 12, but showing a forming step "e"
Figure 19:
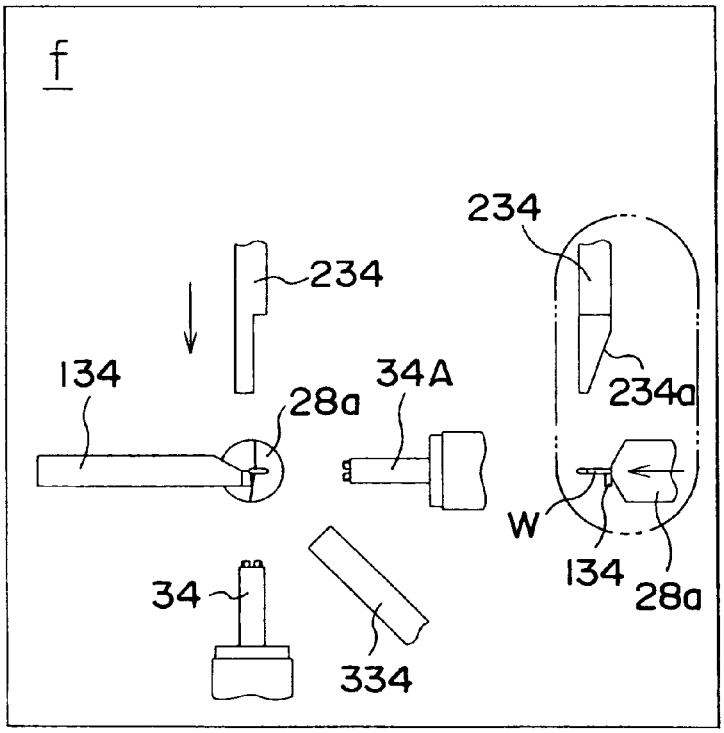
FIG. 19 is a diagram similar to FIG. 12, but showing a forming step "f"
Figure 20:
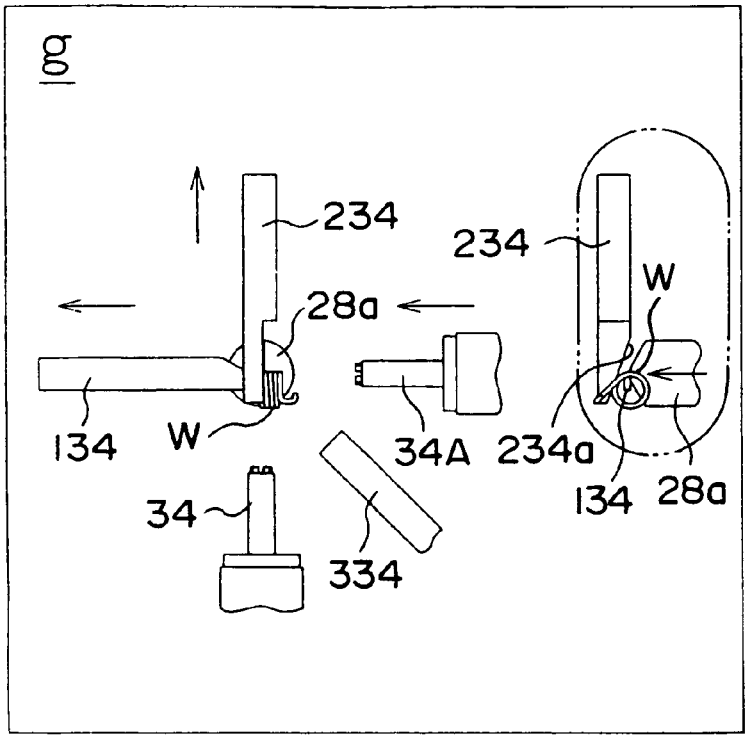
FIG. 20 is a diagram similar to FIG. 12, but showing a forming step "g"

(4) Forming step "d" (FIGS. 16 and 17): This step corresponds to a bent part "d" of the torsion coil spring 130 shown in FIGS. 9 and 10. In a condition where the wire W is positioned between the pair of protruding elements 34*a* and 34*a* of the bending tool 34 in step $d_i$ as shown in FIG. 16, the bending tool 34 rotates 110° in the normal direction (see +110 added on the right side of the circled "d" on the forming sequence line in FIG. 11 and the diagram shown within the circle traced in a phantom line in FIG. 16) and then rotates 20° in the reverse direction in step $d_{ii}$ as shown in FIG. 17 (see −20 added on the right side of the circled "d" on the forming sequence line in FIG. 11 and the diagram shown within the circle traced in a phantom line in FIG. 17), whereafter the bending tool 34 retreats (see the falling oblique line on the wire working unit 30A line in FIG. 11, and FIG. 17).

(5) Forming step "e" (FIG. 18): This step corresponds to a straight part "e" of the torsion coil spring 130 shown in FIGS. 9 and 10. The wire W is fed out (see the double circled "e" on the forming sequence line in FIG. 11), and the bending tool 34 retreats and rotates 90° in the reverse direction (see −90 added under the double circled "e" on the forming sequence line in FIG. 11. In this condition, the bending tool 34 is set at the initial rotating angle.). Further, the backup mandrel 134 which is the working tool of the wire working unit (backup mandrel unit) 30B advances (see the rising oblique line on the unit 30B line in FIG. 11).

(6) Forming step "f" (FIG. 19): This step corresponds to a coiled part "f" of the torsion coil spring 130 shown in FIGS. 9 and 10. Successively to advancement of the backup mandrel 134 of the wire working unit (backup mandrel unit) 30B, the coiling tool 234 of the wire working unit (coiling unit) 30C advances (see the rising oblique line on the coiling unit 30C line in FIG. 11) and the wire W is fed out. The wire abuts on the slanted working surface 234*a* of the coiling tool 234 and the coiled part (spiral part) "f" which is a main body of the spring is formed continuously.

(7) Forming step "g" (FIG. 20): This step corresponds to a straight part "g" of the torsion coil spring 130 shown in FIGS. 9 and 10. Both the backup mandrel 134 of the wire working unit (backup mandrel unit) 30B and coiling tool 234 of the wire working unit (coiling unit) 30C retreat (see the falling oblique lines on the backup mandrel coiling unit 30B line and backup mandrel coiling unit 30C line in FIG. 11) and the wire W is fed out to a position shown in FIG. 21 (see the doubled circled "g" on the forming sequence line in FIG. 11).

Figure 21:
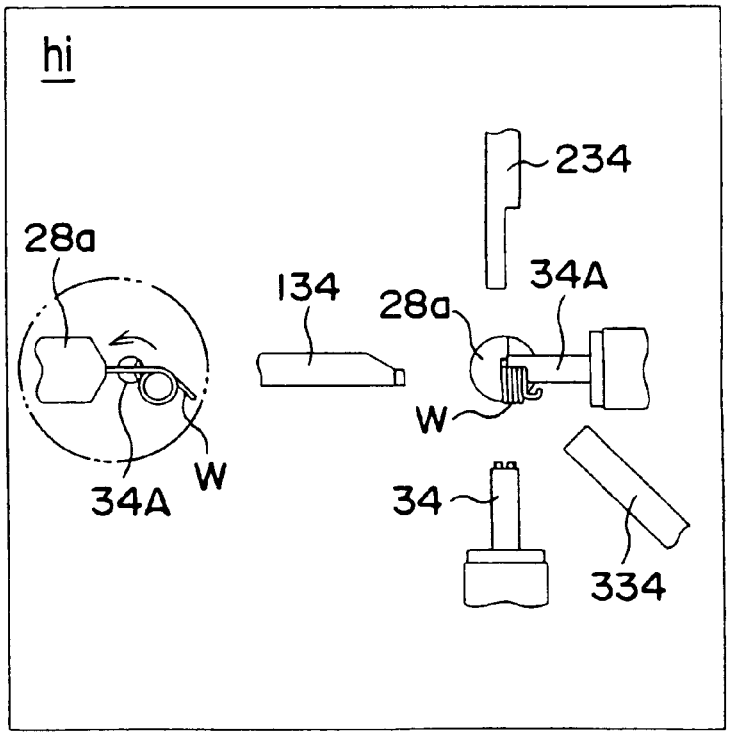
FIG. 21 is a diagram similar to FIG. 12, but showing an initial forming step "$h_i$"
Figure 22:
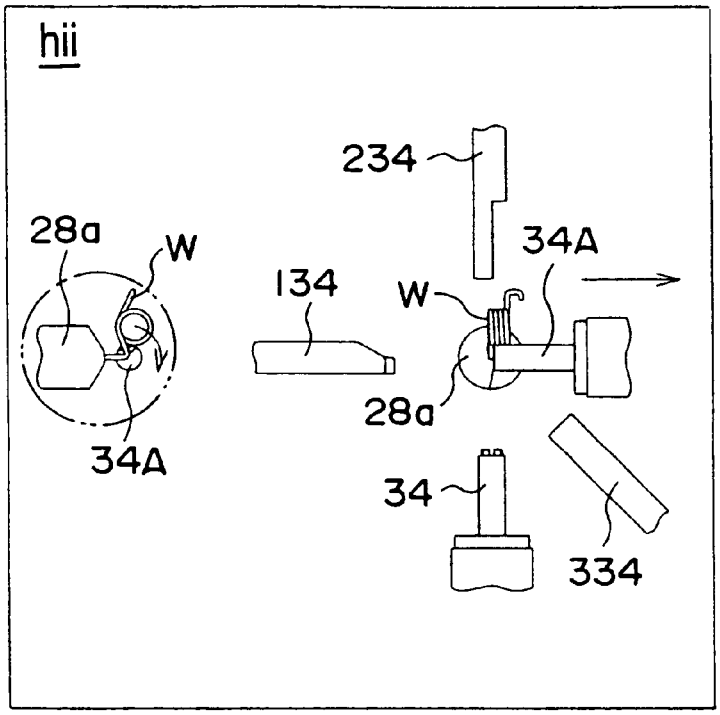
FIG. 22 is a diagram similar to FIG. 12, but showing a latter forming step "$h_{ii}$"
Figure 23:
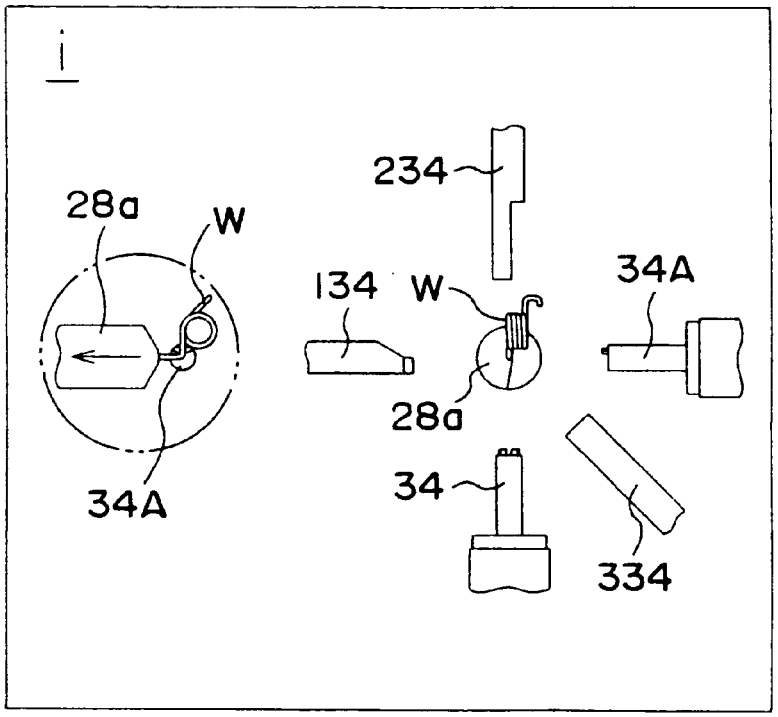
FIG. 23 is a diagram similar to FIG. 12, but showing a forming step "i"
Figure 24:
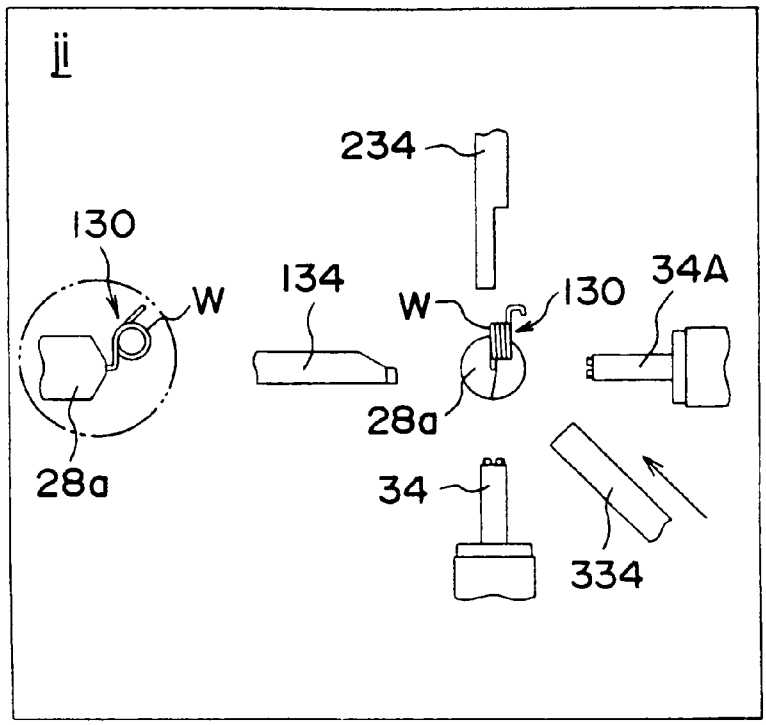
FIG. 24 is a diagram similar to FIG. 12, but showing an initial stage of forming step "$j_i$"
Figure 25:
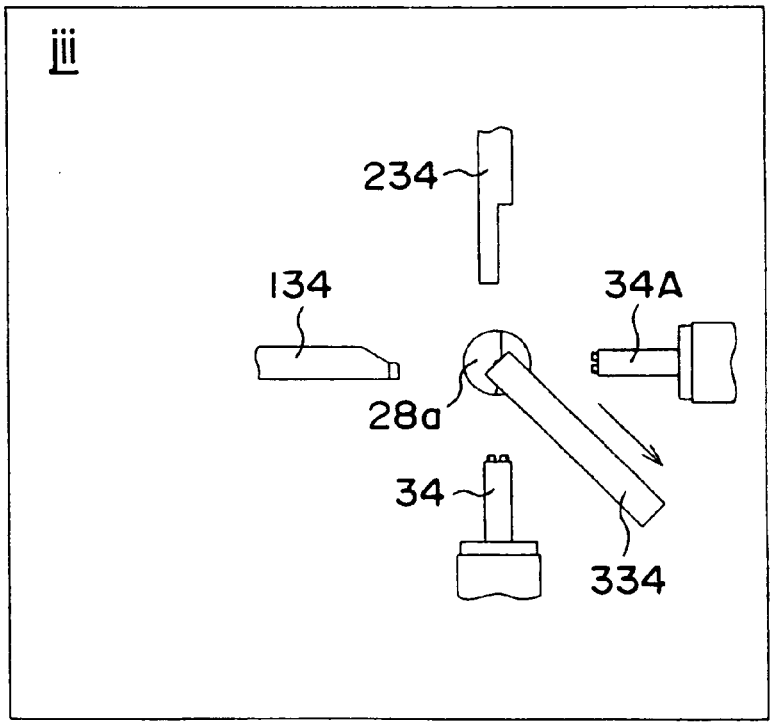
FIG. 25 is a diagram similar to FIG. 12, but showing a latter forming step "$j_{ii}$".

(8) Forming step "h" (FIGS. 21 and 22): This step corresponds to a bent part "h" of the torsion coil spring 130 shown in FIGS. 9 and 10. The bending tool 34A of the wire working unit (bending unit) 30D advances (see the rising oblique line on the unit bending 30D line in FIG. 11) and wire W is positioned between the pair of protruding elements of the bending tool 34A in step $h_i$ as shown in FIG. 21 which is similar to the bending tool 34. Then, the bending tool 34A rotates 110° in the normal direction (see +110 added on the right side of the circled h on the forming sequence line in FIG. 11 and the diagram shown within the circle traced in a phantom line in FIG. 22) and then rotates 20° in the reverse direction in step $h_{ii}$ as shown in FIG. 22 (see −20 added on the right side of the circled "h" on the forming sequence line in FIG. 11 and the diagram within the circle traced in a phantom line in FIG. 23), whereafter the bending tool 34A which is similar to the bending tool 34 (see the falling oblique line on the another bending unit 30D line in FIG. 11, and FIG. 22).

(9) Forming step I and "j" (FIGS. 23 through 25): These steps correspond to a straight part I and a cut part "j" of the torsion coil spring 130 shown in FIGS. 9 and 10. The bending tool 34A of the wire working unit (another bending unit) 30D rotates 90° in the reverse direction and returns to the initial rotating angle (see −90 added on the right side of the circled e on the forming sequence line in FIG. 11), and the cutting tool 334 of the wire working unit (cutting unit) 30E advances and cuts the wire W at a location of a front end surface of the wire feeding quill 28*a*, whereafter the cutting tool 334 of the wire working unit 30E retreats (see the rising and falling oblique lines on the wire working unit 30E line in FIG. 11).

A torsion coil spring 130 is produced upon completing the forming steps described above and the same torsion coil spring 130 is produced one after another by repeating the same steps.

The embodiment described above wherein the first large drive gear 68 for the slider driving mechanism 60 and the second large drive gear 108 for the tool rotating driving mechanism 100 are disposed coaxially with the axial line of the wire feeding quill 28*a* and in parallel with the rear surface of the front base frame panel 1, and a single small drive gear being in engagement with the first large drive gear for the slider driving mechanism, a single small drive gear being in engagement with the second large drive gear for the slider driving mechanism and a plurality of small driven gears corresponding to the plurality of wire working units are disposed around each of these large drive gears makes it possible to operate the slider driving mechanisms for the plurality of wire working units with a single common servomotor 62 and operate the tool rotating driving mechanisms for the plurality of wire working units (bending units) with a single common servomotor 102. Further, by disposing a single small drive gear being in engagement with the first large drive gear for the slider driving mechanism, a single small drive gear being in engagement with the second large drive gear for the slider driving mechanism and a plurality of small driven gears corresponding to the plurality of wire working units around each large drive gear, it is possible to arrange the plurality of wire working units radially around the axial line of the wire feeding quill 28*a* on the outer surface of the front based frame panel 1 and correspond each of the plurality of wire working units to each of the small driven gears, thereby enabling a simplified configuration of the spring forming apparatus and reduce a spatial volume to be occupied by the plurality of wire working units. When the axial line of the wire feeding quill 28*a* is aligned with an axial line of each large drive gear in particular, a space is utilized highly effectively and the spring forming apparatus as a whole including the plurality of wire working units is configured compactly. Further, the embodiment which is configured to advance and retreat the working tools of all the wire working units with the single servomotor, and rotate all the working tools of all the wire working units to be rotated with the single servomotor makes it possible to simplify a control program of an NC device, and reduce a manufacturing cost of a spring forming apparatus and manufacturing prime cost of springs.

As will be apparent from the above, the spring forming apparatus according to the present invention has advantages which are described below:

(1) The spring forming apparatus can be configured simply, composed of a reduced number of parts and manufactured at a reduced cost since it adopts a configuration where a single common motor operates each of the wire feeding driving mechanisms common to a plurality of wire working units, a plurality of slider driving mechanisms corresponding to a plurality of wire working units and a plurality of tool driving mechanisms corresponding to a plurality of wire working units, a power of the single common motor is distributed by a control device and the driving mechanisms are operated in a sequence predetermined depending on the shapes of wires to be formed.

(2) The spring forming apparatus which includes the wire bending units, the coiling unit and the cutting unit as a plurality of wire working units is capable by itself of manufacturing various kinds of spring products. It is capable of manufacturing more kinds of spring products when it adopts a configuration where working tools are detachably held by working tool holders.

(3) The spring forming apparatus enhances space utilization efficiency by adopting a single, common first large gear for the plurality of slider driving mechanisms corresponding to the plurality of wire working units and arranging the plurality of first small driven gears corresponding respectively to the plurality of slider driving mechanisms so as to be in engagement with a circumference of the first large gear.

(4) When the tool rotating driving mechanisms are provided for a plurality of wire working units, space utilization efficiency is enhanced by adopting the single, common second large gear and arranging the plurality of second small driven gears corresponding to the plurality of tool rotating driving mechanisms around the second large gear so as to be in engagement with a circumference thereof.

(5) The configuration where the first large gear and the second large gear for the tool rotating driving mechanisms are disposed in parallel with each other between the wire feeding rollers arranged along the axial line of the quill and the quill utilizes a space with a high efficiency and makes compact the spring forming apparatus as a whole including the plurality of wire working units.

(6) The wire bending tool which has the pair of protruding elements is capable of bending a wire by rotating the bending tool around the axial line in a condition where the wire passes between the protruding elements and permits bending a wire at various angles by selecting optional rotating angles for the bending tool.

(7) The cam of the movement turning mechanism in the slider driving mechanism is rotated at an angle within 360° under control of the control device to advance and withdraw the slider assembly, thereby being capable of advancing and retreating the plurality of working tools at optional adequate timings depending on required shapes of wires to be formed.

(8) The spring forming apparatus according to the present invention is capable of selectively and freely forming hook parts and coil parts of torsion coil springs having coil hook parts and coil parts, torsion springs having no coil parts, tension coil springs having hook portions and coil parts, etc.

This invention is not limited to the embodiments described above, but encompasses all modifications falling within the scope of the following claims.

What is claimed is:

1. A spring forming apparatus comprising:

a wire feeder unit including at least a pair of wire feeding rollers that feed wire into a wire working region through a quill, and a plurality of separate wire working units to bend and cut the wire to obtain a spring, wherein the plurality of wire working units are disposed radially around the axis of the quill, each of the wire working units has a slider assembly which moves perpendicularly between an advanced position and a retreated position with relation to the axis of the quill and which carries an elongate working tool which is held by a working tool holder as a portion of the slider assembly, the working tool and working tool holder of at least one of the wire working units being rotatable about a longitudinal axis of the elongate working tool, the working tool being engageable with the wire in the wire working region when the slider assembly is positioned at the advanced position and retreating from the wire working region when the slider assembly is positioned at the retreated position, wherein the working tool holder of at least one of the wire working units is rotatable, with the working tool, around the longitudinal axis of the working tool, the longitudinal axis being perpendicular to the axis of the quill, wherein the spring forming apparatus further comprises a wire feeding driving mechanism which drives the wire feeding rollers, a slider driving mechanism by which each of the slider assemblies is moved perpendicularly between the advanced position and the retreated position with relation to the axis of the quill, a tool rotating driving mechanism for rotating the working tool holder, with the working tool, around the longitudinal axis of the working tool, and a control device for operating the wire feeding driving mechanism, the slider driving mechanism and the tool rotating driving mechanism in a sequence determined by a form of the spring, and wherein a volume of the wire fed through the quill, which includes a wire length or a wire supply speed, a moving volume of a front end of the slider assembly between the advanced position and the retreated position, which includes a feeding length and a feeding speed, and a rotating volume of at least one of the working tool holders, which includes a rotational angle and a rotational speed, are controlled by the control device, whereby the wire is subjected to bending and cutting operations by the plurality of the working tools held by the plurality of the working tool holders, respectively.

2. A spring forming apparatus according to claim 1, wherein:

the plurality of slider driving mechanism comprises a driving motor for the slider assembly, a first common large gear which is driven by the driving motor for the slider assembly, a plurality of first small gears which are arranged circumferentially in engagement with the first large gear and correspond to the plurality of slider driving mechanism, respectively, and a plurality of movement turning mechanisms by which movements of the first small gears are turned into linear motions to move the slider assembly, respectively, the driving motor for the slider assembly being able to be controlled in a rotational speed and a rotational angle.

3. A spring forming apparatus according to claim 1, wherein:

at least one of the working tools comprises a wire bending tool which has a pair of projections on an end thereof facing a side of the wire fed through the quill, the projections having a gap allowing the wire to pass through therebetween, whereby the wire positioned between the pair of projections is bent when the wire bending tool rotates around a longitudinal axis of the wire bending tool.

4. A spring forming apparatus according to claim 1, wherein:

the working tools are detachably held by the working tool holder.

5. A spring forming apparatus according to claim 1, wherein:

the working tool holders of at least two wire working units are designed to be driven to rotate together with the working tools around the longitudinal axes of the working tools, respectively, the respective longitudinal axes being perpendicular to the axis of the quill.

6. A spring forming apparatus according to claim 1, wherein:

at least two of the tool rotating driving mechanisms comprise a driving motor for rotating the tools, a common second large gear which is driven by the driving motor for rotating the tools, at least two second small gears which are arranged circumferentially and in engagement with the second large gear and correspond to the at least two tool rotating driving mechanisms, respectively, and at least two rotational movement axially turning mechanisms by which an axial direction of of each the rotational movement of the second small gears are turned to rotate the working tool holders and the working tools, respectively, and the driving motor for rotating the tools can be controlled in terms of a rotational speed and a rotational angle.

7. A spring forming apparatus according to claim 2, wherein:

each of the plurality of movement converting mechanisms comprises a cam, a cam follower which is always kept in contact with a cam profile of the cam, and a swing arm which carries the cam follower and pivotally moves around a pivot whereby each of the slider assemblies move between the advanced position and the retreated position generally perpendicularly to the axis of the quill in accordance with movement of the swing arm.

8. A spring forming apparatus according to claim 2, wherein:

the tool rotating driving mechanism comprises a driving motor, a second large gear which is driven by the tool rotating driving motor, at least one second small gear which is arranged in engagement with a circumference of the second large gear and each corresponding to a working tool holder, and at least one rotational movement axially rotating mechanism by which the rotational movement of the second small gear rotates the working tool holder and the working tool, the driving motor for the tool rotating driving mechanism being able to be controlled in terms of a rotational speed and a rotational angle.

9. A spring forming apparatus according to claim 2, wherein:

at least one of the working tools comprises a wire bending tool which has a pair of projections on an end thereof facing a side of the wire fed through the quill, the projections having a gap allowing the wire to pass through therebetween, whereby the wire positioned between the pair of projections being bent when the wire bending tool rotates.

10. A spring forming apparatus according to claim 7, wherein:

the cam of each of the plurality of the movement converting mechanisms is rotatable within a predetermined angle range of 0° to 360°.

11. A spring forming apparatus according to claim 7, wherein:

at least one of the working tools comprises a wire bending tool which has a pair of projections on an end thereof facing a side of the wire fed through the quill, the projections having a gap allowing the wire to pass through therebetween, whereby the wire positioned between the pair of projections being bent when the wire bending tool rotates.

12. A spring forming apparatus according to claim 4, wherein:

at least one rotational movement axially rotating mechanism comprises a bevel drive gear which is rotated by the second small gear, a bevel driven gear which is in engagement with the bevel drive gear, and a rotary shaft which co-axially movably and non-rotatably passes through the bevel driven gear and which is connected to the working tool holder, whereby the working tool holder and the working tool rotate together with the rotary shaft.

13. A spring forming apparatus according to claim 8, wherein:

the first common large gear for the slider driving mechanism and the second large gear for the tool rotating driving mechanism are arranged in parallel to each other between the quill and the wire feeding rollers being arranged along the axis of the quill.

14. A spring forming apparatus according to claim 8, wherein:

the driving motor for the tool rotating driving mechanism being controlled so as to rotate at least one working tool holder within an angle range of 0° to 360°.

15. A spring forming apparatus according to claim 8, wherein:

at least one of the working tools comprises a wire bending tool which has a pair of projections on an end thereof facing a side of the wire fed through the quill, the projections having a gap allowing the wire to pass through therebetween, whereby the wire positioned between the pair of projections being bent when the wire bending tool rotates.

16. A spring forming apparatus according to claim 12, wherein:

at least one of the working tools comprises a wire bending tool which has a pair of projections on an end thereof facing a side of the wire fed through the quill, the projections having a gap allowing the wire to pass through therebetween, whereby the wire positioned between the pair of projections being bent when the wire bending tool rotates.

17. A spring forming apparatus according to claim 13, wherein:

at least ore of the working tools comprises a wire bending tool which has a pair of projections on an end thereof facing a side of the wire fed through the quill, the projections having a gap allowing the wire to pass through therebetween, whereby the wire positioned between the pair of projections being bent when the wire bending tool rotates.

* * * * *